US010493322B2

(12) United States Patent
Yang

(10) Patent No.: US 10,493,322 B2
(45) **Date of Patent: *Dec. 3, 2019**

(54) HUMAN HAND-CRAWLING APPARATUS

(71) Applicant: Weipeng Yang, Houston, TX (US)

(72) Inventor: Weipeng Yang, Houston, TX (US)

( * ) Notice: Subject to any disclaimer, the term of this patent is extended or adjusted under 35 U.S.C. 154(b) by 89 days.

This patent is subject to a terminal disclaimer.

(21) Appl. No.: 15/679,132

(22) Filed: Aug. 16, 2017

(65) Prior Publication Data

US 2018/0015323 A1 Jan. 18, 2018

Related U.S. Application Data

(63) Continuation-in-part of application No. 15/238,387, filed on Aug. 16, 2016, now Pat. No. 9,750,973.
(Continued)

(51) Int. Cl.
*A63B 23/035* (2006.01)
*A63B 21/00* (2006.01)
(Continued)

(52) U.S. Cl.
CPC ..... *A63B 23/0355* (2013.01); *A61H 3/0277* (2013.01); *A61H 3/0288* (2013.01);
(Continued)

(58) Field of Classification Search
CPC ..... A61H 3/0277; A61H 3/0288; A63B 21/0004; A63B 21/023; A63B 21/4015;
(Continued)

(56) References Cited

U.S. PATENT DOCUMENTS 3,174,494 A 3/1965 Maguire, Jr.
3,992,023 A 11/1976 Moorer
(Continued)

FOREIGN PATENT DOCUMENTS

KR 100828099 5/2008

OTHER PUBLICATIONS

ISA/KR—PCT/US2017/047235—counterpart PCT application—International Search Report and Written Opinion and transmittal notification dated Feb. 1, 2018, ten pages.

*Primary Examiner* — Megan Anderson
(74) *Attorney, Agent, or Firm* — Gordon G. Waggett, P.C.

(57) ABSTRACT

A height-adjustable apparatus using a spring to urge forward and rearward undulating whippy locomotion is disclosed. A hand-crawling embodiment having a hand-glove assembly affixed to a base assembly enables users to engage in all-fours crawling locomotion while the body is conventionally situated in a two-legged orientation. One embodiment includes a forearm support bracket mounted at either a permanent or adjustable wrist angle. An internal stabilizer cylinder retainer is also provided to reduce inward pivoting of the internal stabilizer cylinder retainer in the direction of the opposite hand while permitting outward pivoting toward the outside of the device, and front-to-back pivoting toward the front side or backside of the device. A similar foot-bounding embodiment enables walkers, joggers, runners and jumpers to engage in forward and backward whippy locomotion. A crutch embodiment having a similar base assembly enables crippled or injured users to likewise engage in whippy locomotion.

29 Claims, 29 Drawing Sheets

Related U.S. Application Data

(60) Provisional application No. 62/282,937, filed on Aug. 17, 2015, provisional application No. 62/386,960, filed on Dec. 18, 2015.

(51) Int. Cl.

| | |
|---|---|
| ***A61H 3/02*** | (2006.01) |
| ***A63B 69/00*** | (2006.01) |
| ***A63B 25/00*** | (2006.01) |
| ***A63B 25/02*** | (2006.01) |
| ***A63B 26/00*** | (2006.01) |
| *A63B 21/02* | (2006.01) |
| *A63B 71/06* | (2006.01) |

(52) U.S. Cl.
CPC ..... *A63B 21/4015* (2015.10); *A63B 21/4019* (2015.10); *A63B 25/00* (2013.01); *A63B 25/02* (2013.01); *A63B 26/003* (2013.01); *A63B 69/0028* (2013.01); *A63B 21/0004* (2013.01); *A63B 21/023* (2013.01); *A63B 69/0057* (2013.01); *A63B 2071/0694* (2013.01); *A63B 2208/0295* (2013.01); *A63B 2209/10* (2013.01); *A63B 2225/09* (2013.01); *A63B 2225/093* (2013.01)

(58) Field of Classification Search
CPC . A63B 21/4019; A63B 23/0355; A63B 25/00; A63B 25/02; A63B 26/003; A63B 69/0028; A63B 69/0057; A63B 2071/0694; A63B 2208/0295; A63B 2009/10; A63B 2225/09; A63B 2225/093
See application file for complete search history.

(56) References Cited

U.S. PATENT DOCUMENTS

| | | | | |
|---|---|---|---|---|
| 4,688,789 | A | 8/1987 | Alter | |
| 5,038,811 | A | 8/1991 | Gilmore | |
| 5,458,143 | A | 10/1995 | Herr | |
| 5,571,065 | A | 11/1996 | Buitoni | |
| 5,890,259 | A * | 4/1999 | Sarac | A01B 1/00 16/422 |
| 6,080,087 | A | 6/2000 | Bingham | |
| 6,440,045 | B1 | 8/2002 | Gaston | |
| 6,719,671 | B1 * | 4/2004 | Bock | A63B 25/10 482/75 |
| 7,686,025 | B1 | 3/2010 | Dowling | |
| 7,823,599 | B2 | 11/2010 | Thibodeau et al. | |
| 7,950,975 | B1 | 5/2011 | Chapman, Jr. | |
| 7,998,043 | B2 | 8/2011 | Zhou et al. | |
| 8,272,146 | B1 * | 9/2012 | Jackson, II | A43B 3/0078 36/15 |
| 2002/0083616 | A1 | 7/2002 | Hajianpour | |
| 2006/0211545 | A1 | 9/2006 | Smyer | |
| 2012/0244998 | A1 | 9/2012 | Rao | |
| 2013/0123082 | A1 | 5/2013 | Bashraheel | |
| 2015/0065311 | A1 | 3/2015 | Rao | |

* cited by examiner

HUMAN HAND-CRAWLING APPARATUS

CROSS-REFERENCE TO RELATED APPLICATIONS

This application claims the benefit of the filing date of and priority to: U.S. Nonprovisional application Ser. No. 15/238,387 entitled "Human Hand-Crawling and Foot-Bounding Apparatus" and filed Aug. 16, 2016, Confirmation No. 2673, now U.S. Pat. No. 9,750,973; which in turn claims the benefit of the filing date of and priority to U.S. Provisional Patent Application Ser. No. 62/386,960 filed Dec. 15, 2015 and U.S. Provisional Patent Application Ser. No. 62/282,937 filed Aug. 17, 2015; said applications being incorporated by reference herein in their entireties for all purposes.

STATEMENT REGARDING FEDERALLY SPONSORED RESEARCH OR DEVELOPMENT

Not Applicable.

FIELD OF THE INVENTION

The present invention generally relates to an apparatus for a user to engage in physical exercise, and more particularly relates to an apparatus that enables a user to simultaneously exercise both arms and both legs while crawling on all-fours according to a unique bounding exercise protocol.

BACKGROUND OF THE INVENTION

The background information discussed below is presented to better illustrate the novelty and usefulness of the present invention. This background information is not admitted prior art.

There have been myriad attempts to improve physical exercise and fitness routines to promote an individual's good health and well-being. On a regularly recurring basis, television screens are saturated with infomercials and the like advertising sure-to-succeed exercise and dance routines seemingly guaranteed to develop for the television-viewer a sound body and healthy physique, not to mention to expedite weight reduction and other health benefits. But, there has been significantly less emphasis upon providing low-impact, essentially stress-free exercises and the like targeted for use by injured or handicapped or otherwise crippled personnel or senior citizens or even the elderly. Indeed, generally, rehabilitation and exercise routines have typically been the exclusive bailiwick of professional therapists and the health-care professionals.

Nevertheless, there have been attempts to improve the state of the art for promoting such disadvantaged individuals' good health and well-being. For instance, in U.S. Pat. No. 3,174,494, Maguire discloses a contoured crutch which has a hand grip contoured to receive the heel of the hand. Positioned upwardly from the rear of the hand grip is a concave or hollowed-out arm receiving section which continues up to a little bit above the elbow of the user, or may be of just sufficient length to receive part of the forearm. A body support, shaped somewhat like the conventional under-arm or armpit grip, but curved to fit more comfortably against the side of the body as well as in the armpit, forms the top portion of the crutch and is situated just slightly above the top portion of the arm support. The hand grip has a rear portion which is somewhat flattened and of an enlarged area, and which is contoured to receive the heel of the user's hand, and has a slightly convex contoured portion to fit into the palm of the hand, while the fingers may be lapped around the forward portion of the hand grip and the other edge indented a concavity to comfortably fit the grasping thumb. The curved arm support extending up from the heel of the hand receives the forearm and the elbow and the lower portion of the upper arm to be supported and maintained thereby. At the same time this arm support, behind the forearm and elbow, does not completely capture these parts, so that the individual using the crutch is not deprived of complete freedom of movement of the arm into other positions if necessary or intended.

As another example, Gilmore, in U.S. Pat. No. 5,038,811, discloses overcoming a long-standing deficiency of spring-tension crutch cuffs and also cuffs tend to be loose-fitting to facilitate insertion of forearms thereinto but fail to grip the forearm with sufficient firmness to assure stability. A cylindrically-curved cuff pivotally connected to joinder member by a pivot pin/bolt; joinder member configured with pair of orthogonal angularly-spaced side arms. The cylinder is split and grooved at approximately 15° from a lug, thereby forming a narrow thin hinge section. This split and hinge divide the cylindrical cuff strap into a larger section that is fixed with respect to lug and a smaller movable section that is pivoted for enabling swinging movement toward and away from the free end thereof. This configuration is essential so that the larger fixed section overhangs the forearm of the user so that the crutch remains hanging from the forearm, even though the smaller section is wide open, while at the same time the opening provided is sufficiently wide to allow the forearm to be removed sideways from the cuff.

Still another crutch-based improvement in the art was disclosed by Herr in U.S. Pat. No. 5,458,143 in which a crutch having an elbow spring and shank spring permits maximum locomotion efficiency by a user for maneuvering over flat surfaces, up and down steps, and up and down hills. It attaches to user's arm wherein elastic springs absorb the energy of impact of the crutch with a surface and then releases this energy to propel the user upwards and forwards. The Herr Crutch also has springs for storing energy when the elbow flexes and releases energy to assist elbow extension, thereby enabling the user to invoke both elbow muscle flexors and extensors to ascend stairways and hills. This invention demonstrates how springs can be used in a crutch to maximize cushioning, stability, and efficiency.

Bingham, in U.S. Pat. No. 6,080,087, discloses an apparatus to assist a developmentally-delayed child assume various postural and ambulatory positions including oblique or horizontal crawling all-fours or quadruped positions. Straps are connected proximal to a child's rear hip and height-adjustment is readily achieved in order to hold the child at a predetermined height, thereby enabling the child to move down to a hand-and-knee weight-bearing crawling position or up therefrom in a non-weight-bearing, suspended position from above. Embodiments can also be used for disabled adults. The straps are strategically emplaced upon a user's shoulder areas and interconnected with an axially slidable adjustable damping member that limits the "bounce" invoked as incentive to trigger controlled creeping or quadruped movement Buitoni, in U.S. Pat. No. 5,571,065, teaches extending the reach of a user's forearms for equalizing the hip-to-foot distance and shoulder-to-forearm extension distance. The rear dorsal portion of a user's hand grasps a brace in the forward direction and elbow-end of his forearm is grasped by an arm-embracer, and at least a portion of the wrist-end of the forearm contacts a forearm support at its forward-facing surface. With this brace being connected to a post, the brace-post combination is slidably engaged and coupled by a shock-absorbing coupling. The outer end of the post terminates in a foot that, when contacting the ground, enables the brace-post combination to rotate about an axis perpendicular to the forward direction. Accordingly, the foot may be hinged to the post, interconnected to the post with a flat spring, or have a lower cylindrical surface—having along axis parallel to the axis of rotation. The shock-absorbing coupling reduces impulse transmitted to the user's writ and shoulder as the user's foot strikes the ground.

In U.S. Pat. No. 4,688,789, Alter discloses pair of arm braces that enable walking or running movement on all fours that simultaneously exercises arms and legs absent any back stress, which is commonly experienced during conventional locomotion in a vertical orientation—on two feet of course—absent squatting. These relatively short braces are grasped akin to crutches wherein the back dorsal portion of the user's hands are facing outwards, perpendicular to direction of movement. This orientation appears to be counterproductive to facilitating users' all-fours stride-length (similar to that of a four-legged animal). Lengths of its support member and U-shaped member are selected wherein the arm brace compensates for different length of a user's arms and legs. Similarly, in U.S. Pat. No. 7,998,043, Zhou et al. disclose a prone crawling dual-track exercise apparatus that simulates a four-limbed animal's crawling-based locomotion; and in U.S. Pat. No. 3,352,356, Lillibridge discloses a creeping device for assisting physically and mentally retarded users perform creeping-based exercises.

Accordingly, while limited progress has been made for enabling physically or mentally challenged individuals to engage in regular exercise routines to promote health and wellness, what is needed in the art is an apparatus that effectively enables users of virtually all physical and mental conditions, regardless of whether normal or injured or handicapped or otherwise deficient, to participate in essentially natural crawling-based exercise routines that require minimum balance and stability attributes, and nevertheless afford maximum benefit to be derived from simultaneously implicating both arms and both legs in an all-fours protocol. These limitations and disadvantages of the prior art are overcome with embodiments of the present invention, wherein improved means and techniques are provided which are especially useful for effectuating all-fours exercise routines in which the user has the benefit of invoking an embodiment of the instant hand-crawler glove apparatus that enables exercises to be conducted at a pace commensurate with the user's physical and mental capabilities and athletic prowess, while inherently avoiding undue impact or stress upon the user's anatomy and intertwined joints and musculature. The prior art appears to be devoid of any convenient and sufficiently portable apparatus that reliably enables a user to engage in challenging all-fours crawling exercises as contemplated herein.

SUMMARY OF THE INVENTION

The present invention teaches a hand-crawling apparatus that enables a user to engage in all-fours crawling locomotion rather than engaging in walking, jogging and/or running while the body is conventionally inherently situated in a substantially two-legged vertical orientation frequently associated with strain on the back, joints and implicated anatomical structures. More particularly, embodiments of the present invention facilitate users of virtually all levels of physical and mental health and wellness to effectively engage in all-fours crawling exercises associated with minimal strain on the back, joints and implicated anatomical structures.

The present invention also teaches a foot-bounding and rebounding apparatus that enables walkers, joggers, runners and even jumpers to engage in unique forward and backward locomotion while essentially positioned erect on two feet or alternatively while using one or two crutches to effectuate such locomotion.

Embodiments of the human hand-crawler apparatus contemplated herein enable even a user plagued with an imbalance condition or suffering from a temporary or permanent physical disability to engage in challenging physical exercise that inherently minimizes the demands and stress associated with physical exercise, by enabling such a user to simultaneously exercise both arms and legs while crawling on all-fours at varying rates of speed depending upon user-physical capability.

Hand-crawler glove embodiments taught herein are configured for each of a user's hands to be easily inserted thereinto, with each hand disposed within a respective hand-crawler glove affixed to a substantially horizontal hand-platform. This hand-platform is preferably disposed substantially parallel to a spaced-apart cushioned layered base member having a vertical threaded post member disposed therebetween. The hand-platform and base member are flexibly joined by a combination of a spring member disposed circumferentially of the post member and within a housing, in one embodiment hereof, in conjunction with an arcuate flexible brace member disposed at one end of the base member. Once the user's hands are inserted into each of a pair of hand-crawler gloves and secured thereinto, the user engages in all-fours crawling under unique upwards and downwards undulating vertical spring-driven motion while synchronously progressing horizontally on the ground in whippy-like locomotion as will be elucidated herein.

In another embodiment hereof, the hand-platform and base member are also flexibly joined by just a spring member disposed circumferentially of the post member and within a suitable housing. As will be appreciated by those skilled in the art, in order for this alternative embodiment to sustain prerequisite stability without unduly compromising contemplated flexibility, the spring should afford suitable compression-expansion characteristics in a manner well known in the art. It is contemplated that embodiments of the present invention would be commercially available in kit-form or package-form having a variety of interchangeable spring members to accommodate users of varying sizes and weights.

In still another embodiment hereof, the stability of the hand-platform may be reinforced by a readily removable stabilizer cylinder that inherently supplements the vertical integrity of the underlying apparatus. As will become apparent to those conversant in the art, incorporating this stabilizer cylinder into the instant hand-crawling glove apparatus has been particularly advantageous for overweight users or adult users suffering from balance limitations.

In yet another embodiment hereof, a spiral-driven, spring-based crutch apparatus is disclosed which would be profoundly useful in conjunction with a specially-adapted crutch. As is commonplace in the art, such a specially-adapted crutch or pair of crutches would be adjusted to a user's size attributes and then the threaded pole portion thereof would be screwably inserted into the apparatus taught hereunder to enable the user to benefit from engaging in whippy locomotion as will be hereinafter described.

In another embodiment hereof, a spiral-driven, spring-based foot-bounding apparatus wherein a user would essentially stand erect during locomotion is disclosed which has been found to be particularly advantageous for such fitness activities as power-walking, jogging, running and even jumping.

It is an object and advantage of embodiments of the present invention to provide a convenient, inexpensive and lightweight portable hand-crawling apparatus that facilitates all-fours crawling locomotion.

It another object of the present invention to provide a hand-crawler apparatus having an interchangeable spring mechanism that urges a user's upper body to intermittently rise and fall vertically in a controlled manner similar to whippy locomotion, as taught herein.

It yet another object of the present invention to provide an apparatus for engaging in all-fours crawling exercise routines at various speeds commensurate with the user's physical and mental capability and athletic prowess, while incurring minimal impact upon the user's anatomy and implicated joints, ligaments and musculature.

It another object of the present invention to provide a spring-based crutch apparatus having an interchangeable spring mechanism that urges a user's upper body to intermittently rise and fall vertically in a controlled manner similar to whippy locomotion, as taught herein.

In one embodiment, there is disclosed a hand-crawling apparatus having a pair of hand-crawling members for enabling a user having particular weight and height attributes to engage in whippy locomotion, with each hand-crawling member thereof comprising: a hand-glove assembly having a planar hand-platform member with a top surface and a bottom surface; a hand-embracing member affixed to the top surface of the planar hand-platform member; a cylindrical post assembly affixed at one end thereof to the bottom surface of the hand-platform member having a cylindrical post member projecting perpendicularly therefrom and downwardly thereof, with external threads circumferentially disposed upon the cylindrical post member; a base assembly comprising a cylindrical housing member with an axially disposed central whorl hole with internal threads sized to mate with the external threads of the cylindrical post member at one end thereof, and threadedly attached to the cylindrical post member; and the base assembly having a replaceable spring member disposed immediately below the cylindrical housing member and secured in a substantially vertical position between a first retainer member affixed thereto at one end of the replaceable spring member and a second retainer member therebelow affixed to a substantially planar base plate member at the other opposite end of the replaceable spring member.

In one embodiment, the hand-embracing member comprises a front hand-embracing member disposed at a first end of the planar hand-platform member and affixed thereto, for embracing fingers of the hand of a user and having a strap member for securing the fingers thereto. In another embodiment, the hand-embracing member comprises a rear hand-embracing member disposed at a second end of the planar hand-platform member, oppositely of the first end thereof, and attached to the hand-platform member, for embracing a heel and wrist of the hand of the user and having a strap member for securing the heel and the wrist thereto, thereby preventing lateral movement thereof. In other embodiments, the planar hand-platform member comprises shock-absorption material selected from cork or gel to promote comfort and to avoid injury to a plethora of bones and concomitant ligaments and muscles constituting and proximal to hands of the user and similarly, to a back of the user.

The external threads of the cylindrical post member may further comprise a pair of groove members laterally and symmetrically disposed thereupon. The planar hand-platform member may be rotated about the cylindrical post member to adjust a height thereof above the base assembly to be commensurate with the user's height attribute and then is securely engaged with one of the pair of groove members at an adjusted height with a fastener means disposed upon a ring member contiguous with and affixed to the cylindrical housing member.

In another embodiment of the hand-crawling member, the replaceable spring member may be inserted between the first retainer member and the second retainer member, and secured therebetween.

The base plate member may be attached substantially in its entirety therebeneath to a skid-resistant elastomeric sole member by a plurality of stud members affixed to an upper surface of the sole member projecting substantially vertically therefrom which are received in a plurality of stud member holes contained on the base plate member and being secured thereof by a plurality of fastener members.

A method of exercising using a hand-crawling apparatus is disclosed herein of where the pair of hand-crawling members include a first and a second hand-crawling member, where the first hand-crawling member has a first hand-embracing member and a first replaceable spring member and the second hand-crawling member has a second hand-embracing member and a second replaceable spring member, and the user commences undulating alternating upward and downward whippy locomotion therewith, comprising the steps of: (a) receiving one of the user's hands in the first hand-embracing member and the one of the user's hands being releasably secured thereto and receiving another one of the user's hands in the second hand-embracing member and the another one of the user's hands being releasably secured thereto; (b) positioning a body of the user into a crawling posture with each of the first and second hand-crawling members and feet of the user being placed upon the ground; (c) initiating leading forward locomotion with the first hand-embracing member being propelled upwardly by expansion of the first replaceable spring member, while simultaneously a weight of the user self-generates force downwardly thereby urging trailing forward locomotion with the second hand-embracing member imparting pressure thereupon thereby causing the second replaceable spring member to transition from being uncompressed to being compressed; (d) continuing forward locomotion by disposing the first hand-crawling member and the second hand-crawling member in a diametrically opposite arrangement with the second hand-embracing member being propelled upwardly by expansion of the second replaceable spring member, while simultaneously the use's weight self-generates force downwardly thereby urging trailing forward locomotion with the first hand-embracing member imparting pressure on the first replaceable spring member thereby causing the first replaceable spring member to transition from being uncompressed to being compressed; and (e) intermittently effectuating successive compression and decompression of the first replaceable spring member and the second replaceable spring member thereby enabling the whippy locomotion to be continued so long as the user engages the first and second hand-crawling members.

The base assembly may further comprise a brace assembly affixed to a top surface of the base plate member at one end thereof spaced apart from the cylindrical post assembly and with an arcuate flexible brace support member adjoined with the cylindrical housing member at a top portion thereof. The flexible arcuate brace support member may be configured with an arc preferably having an angle from 95° to 135° to augment support of the planar hand-platform member and to simultaneously provide sufficient flexion. The arcuate flexible brace support member may further comprise a zonal flat configuration or a double cylindrical parallel configuration.

The hand-crawling apparatus base assembly may also have a plurality of gap members disposed upon the base plate member and circumferentially of the cylindrical post member for accommodating elastic distortion of the base plate member during the whippy locomotion. Each gap member of the plurality of gap members may be configured as a wedge shaped void cut out from the base plate member. A pair of flat recess members may be disposed upon opposing sides of the post member to enable the first spring retainer member to securely retain the replaceable spring member within the cylindrical housing member.

The base assembly may further comprise a removable stabilizer cylinder member screwably inserted thereinto through a whorl hole centrally disposed on the bottom of the base plate member and threadedly mated therewith and secured therein with an internal stabilizer cylinder retainer member, thereby preventing undue lateral movement of the planar hand-platform member.

In yet another embodiment, the hand-embracing member comprises a forearm support bracket.

These and other objects and advantages of the present invention will become apparent from the following specification and accompanying drawings. In this embodiment, the hand-embracing member may comprise a rear hand-embracing upwardly extending parapet substrate member disposed at a second end of the planar hand-platform member, oppositely of the first end thereof, proximate to the apparatus rear end and attached to the hand-platform member, for embracing a heel and wrist of the hand of the user and for attaching the forearm support bracket, the parapet structure upwardly extending from an inside and an outside edge of the planar hand-platform member proximate the respective inner side and outer side of the apparatus, the forearm support bracket further comprising an upwardly extending member attached at a first end to the parapet substrate for receiving a forearm of the user, and one or more strap members for securing the forearm support bracket to the user's forearm, the forearm support bracket extending upwardly at a desired wrist orientation angle relative to the planar hand-platform member. In one embodiment, the forearm support bracket is fixably attached to the parapet substrate to provide a stationary wrist orientation angle.

In another embodiment, the forearm support bracket is pivotably attached to the parapet substrate about a pivot axis to provide an adjustable wrist orientation angle that can be adjusted, by pivoting the forearm support bracket in a first direction toward the apparatus front end or in a second, opposite direction toward the apparatus rear end and then locked into place prior to use by the user. The first end of the forearm support bracket may comprise opposed leg members capable of being pivotally attached at the forearm support bracket first end to the parapet pivot axis on the respective inside and outside of the parapet substrate and secured in the desired wrist orientation angle. The inside and outside of the parapet substrate may further each comprise an arcuate guide slot generally oriented in a front to back orientation, the opposed legs of the forearm support bracket further comprise guide pins secured thereto capable of travelling within the arcuate guide slot when the forearm support bracket is pivoted front to back, and further capable of securing the forearm support bracket to the parapet substrate in the desired wrist orientation angle. A plurality of raised cogging members may be oriented on a face of the parapet substrate between the arcuate guide slot and the pivot axis, and a plurality of raised cogging members may likewise be oriented on an inner face of each of the opposed members between the guide pins and the pivot axis for frictionally engaging with one or more of the raised cogging members on the outer face of the parapet substrate to assist in maintaining the support bracket in its desired wrist orientation angle.

The hand-crawling apparatus may further comprise a finger slot in the front hand-embracing member for receiving the fingers of the user and/or a cut away section for receiving the user's thumb. For example, a contoured indentation along the inner side of the hand platform member can accommodate a thumb of the user to enhance the user's grip.

In other embodiments, alternate height adjustment mechanisms are provided, such as wherein the cylindrical post member does not comprise external threads, and wherein the base member axially disposed central hole does not comprise whorls, and wherein the cylindrical post member is received into the base member axially disposed central hole in a hydraulically adjustable fashion to permit adjustment of a height thereof above the base assembly to be commensurate with the user's height attribute and then is securely engaged and to then be secured into the desired height with a hydraulic locking mechanism.

In further embodiments of the hand-crawling apparatus, the internal stabilizer member is a generally cylindrical structure extending axially from the lower end of the cylindrical housing member and comprises an outer diameter capable of being inserted into the bore hole of the removable stabilizer cylinder member. In another embodiment, the internal stabilizer member extends downwardly from the lower end of the cylindrical housing member and comprises a first axially offset section oriented facing the inner side of the hand-crawling apparatus which, a second section opposite the first section oriented facing the outer side of the hand-crawling apparatus, a third section oriented facing the front end of the hand-crawling apparatus and a fourth section oriented facing the rear end of the hand-crawling apparatus such that when the internal stabilizer member is inserted into the bore hole of the removable stabilizer cylinder member, it is configured to generally nest up against an internal side wall of the bore hole facing the inner side of the hand-crawling apparatus to reduce lateral movement of the planar hand-platform member in a direction toward the inner side of the hand-crawling apparatus, while permitting lateral movements in directions of the outer side, the front end and the rear end of the hand-crawling apparatus. The internal stabilizer member may further comprise a generally hemispherical end having an outer diameter sized to permit entry into the bore hole of the removable stabilizer cylinder member.

The replaceable spring member may also comprise an inner diameter slightly greater than the outer diameter of the cylindrical housing member, in which case, the first retainer member is affixed to the outer diameter of the cylindrical housing member.

BRIEF DESCRIPTION OF THE SEVERAL VIEWS OF THE DRAWINGS

Referring to the drawings, several aspects of the present invention are illustrated by way of example, and not by way of limitation, in detail in the figures, wherein.

DETAILED DESCRIPTION OF THE INVENTION

Figure 1:
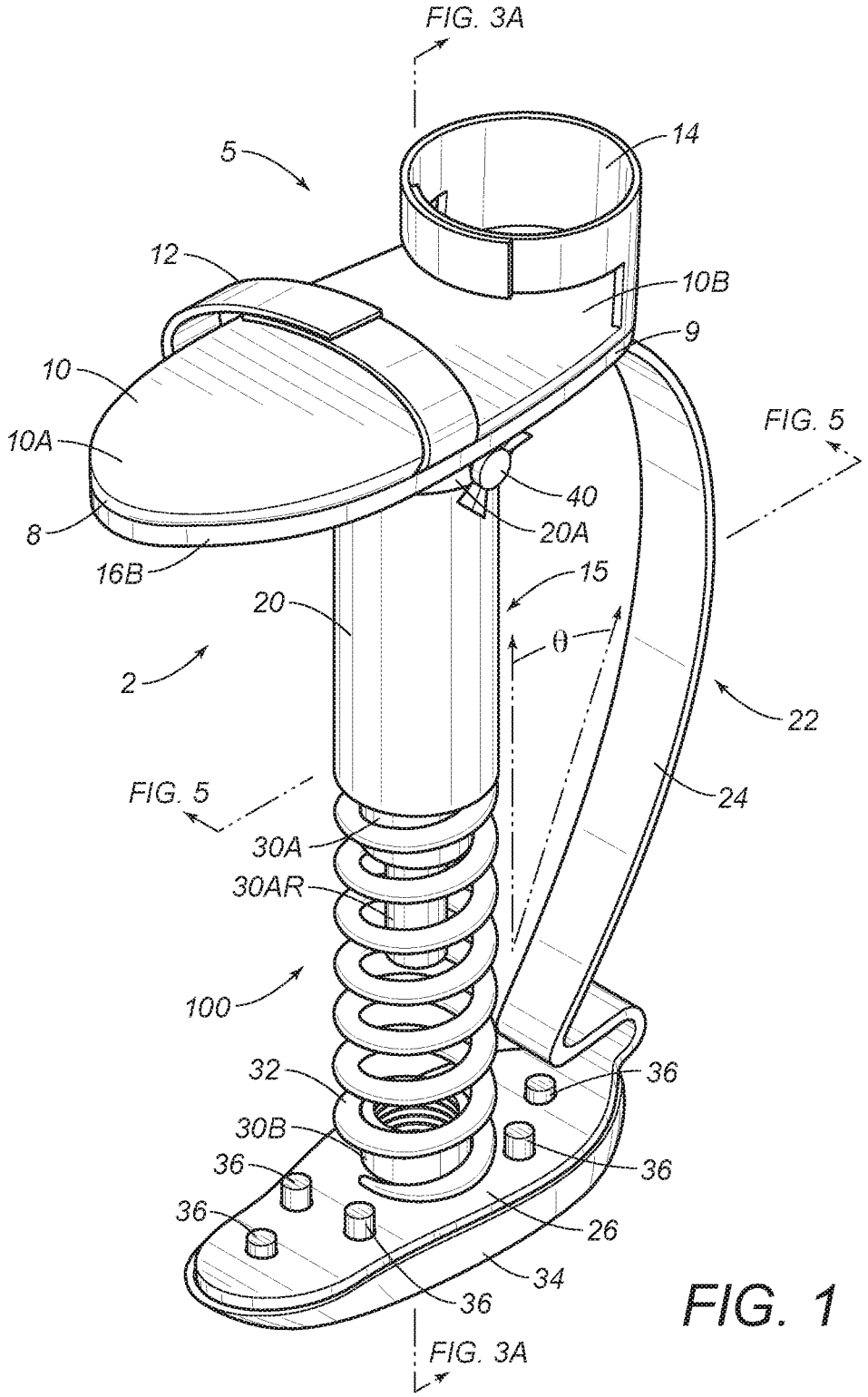
FIG. 1 depicts a frontal perspective view of a spiral-driven hand-crawler embodiment of the present invention with a flat zonal arcuate brace member, having two supporting-points on the bottom of the base.

The following description is of preferred embodiments by way of example only and without limitation to the combination of features necessary for carrying the invention into effect. Reference is to be had to the Figures in which identical reference numbers identify similar components. The drawing figures are not necessarily to scale (except where specifically indicated) and certain features may be shown in schematic or diagrammatic form in the interest of clarity and conciseness.

Reference is made herein to the figures in the accompanying drawings in which like numerals refer to like components. Referring collectively to FIGS. 1-22B, there are depicted various views of nine alternative representative human hand-crawler glove embodiments of the present invention as will be hereinafter described. For instance, spiral-driven hand-crawler glove embodiment 2 is depicted in perspective frontal views in FIGS. 1, and 11, respectively; and depicted in corresponding exploded views in FIGS. 2 and 12, respectively. Similarly, representative spiral-driven crutch embodiment 42 of the present invention is depicted in simplified frontal perspective views in FIGS. 22A and 22B, respectively.

Thus, exemplary of teachings herein, FIGS. 1-8 depict various views of embodiment 2 and FIGS. 11-18 depict similar views of embodiment 7, each such embodiment providing base assembly 100 comprising a dual supporting combination of a substantially vertical interchangeable spring member 32 and a substantially chamfered variously angulated elastic brace member 22 which cooperatively manifest two contact-points on base member 26. As will become clear to those skilled in the art, the various embodiments taught herein enable a human user engaging in an all-fours exercise or like locomotion to jointly promote contemplated undulating alternating upward and downward unique whippy hand-crawling movement. In particular, there are depicted hand-crawler glove embodiments 2 and 7, respectively, having hand-shoe or hand-glove assembly 5 supported therebeneath by centrally disposed base assembly 100 comprising post assembly 15 and brace assembly 22, with base assembly 100 affixed at one end thereof to hand platform member 10 and affixed at the other, opposite end thereof to base member 26. It will become evident that each of post assembly 15 and brace assembly 22 is affixed at a different contact point upon base member 26.

Figure 19:
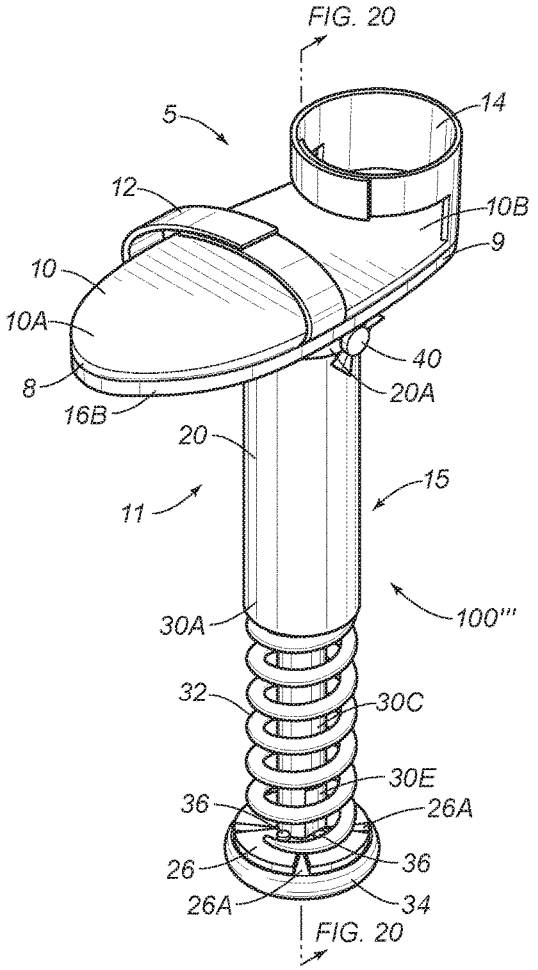
FIG. 19 depicts a frontal perspective view of an alternative spiral-driven hand-crawler embodiment of the present invention, with only one supporting-point on the bottom of the base.
Figure 20:
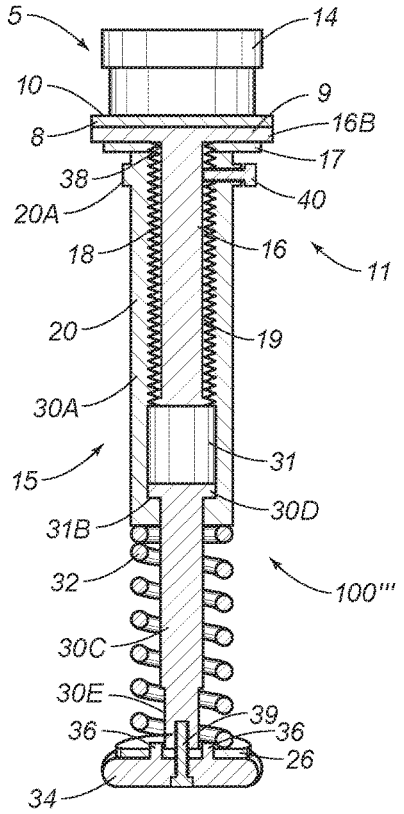
FIG. 20 depicts a frontal cross-sectional view through section line FIG. 20-FIG. 20 depicted in FIG. 19.

Similarly, FIGS. 19-21 depict various views of embodiment 111 providing a single support feature wherein there is included a substantially vertical interchangeable spring member 32 which manifests a single contact-point on base member 26 to promote the undulating alternating upward and downward whippy locomotion inherent in the unique hand-crawling movement taught hereunder.

As will be hereinafter described, these supporting structures enable hand-crawler glove embodiments (alternatively and equivalently referred to as hand-shoe embodiments) to facilitate a user's engaging in alternating bounding and rebounding substantially vertically from the ground beneath the user's crawler-gloved hands, while simultaneously being propelled in a forward direction along the ground. More particularly, it will become evident to those skilled in the art that crawling locomotion contemplated hereunder enables a user to effectuate movement substantially linear and parallel to the ground via a specially orchestrated crawling hand-jumping locomotion manifest by intermittently bounding and rebounding substantially vertically, while simultaneously and synchronously progressing horizontally either in a forward or a backward direction characterized herein as a "whippy" motion pattern.

Figure 2:
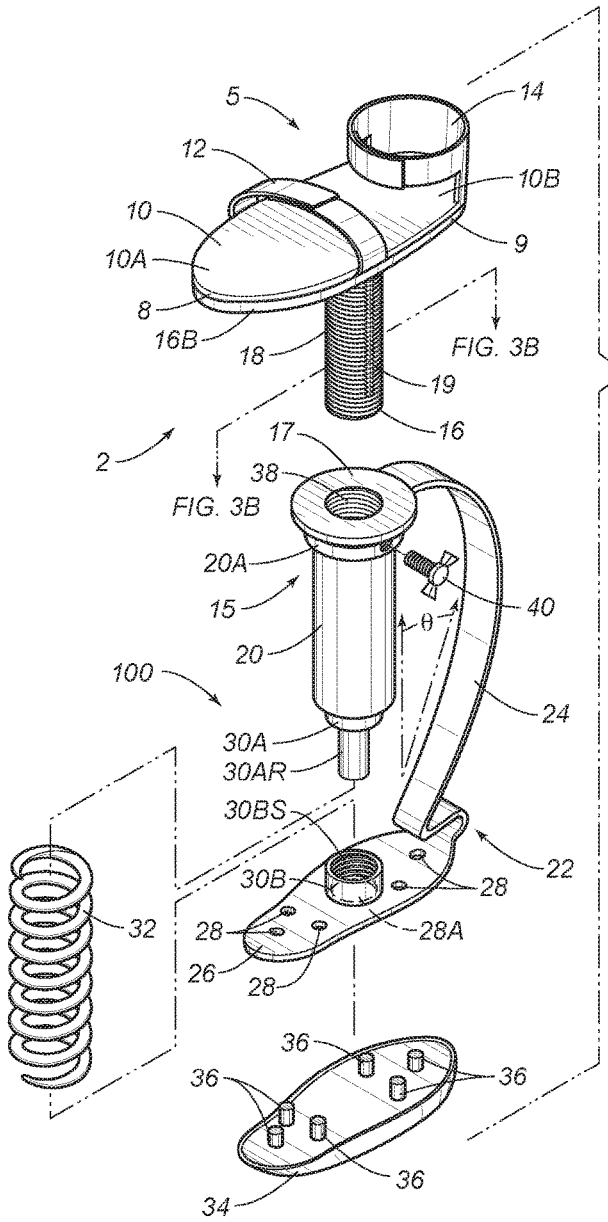
FIG. 2 depicts an exploded perspective view of the embodiment depicted in FIG. 1.

As illustrated in FIGS. 1 and 2, post assembly 15 comprises post member 16 projecting perpendicularly from and downwardly of hand-platform 10, and is disposed centrally within housing member 20 and screwably adjoins hand-shoe glove assembly 5 and base assembly 100 as will be hereinafter described. Base assembly 100 comprises cylindrical housing member 20 disposed at an end thereof proximal to hand-platform 10 and, at the other opposite end thereof, proximal to spring member 32. It will be seen that spring member 32 is disposed immediately below cylindrical housing member 20. Housing member 20 circumscribes the upper portion of post member 16 and is fixedly attached at its upper end to ring member 20A and at its lower end to upper spring retainer member 30A, respectively. As clearly depicted, spring member 32 is disposed in a substantially vertical orientation between upper or top spring retainer member 30A and lower or bottom spring retainer member 30B.

Housing member 20 together with threaded post member 16 enable vertical movement of hand platform 10, which is preferably constructed from rigid metal or sufficiently strong nonmetal materials well known in the art. To assure integrity of the underlying support structure of embodiments hereof, housing member 20 and brace member 24 should preferably be adjoined into an integrated structure, comprising metal and nonmetal materials, via conventional fasteners such as nuts and the like. It should be evident to those skilled in the art that welds would be a viable option for securely adjoining adjacent metal components. The lower portion of the brace member may comprise elastomeric bends, to-and-fro bends, or reciprocating bends 27.

Lower spring retainer member 30B is fixedly attached to substantially horizontal base plate member 26 interconnected with preferably skid-resistant elastomeric sole member 34 therebelow via plurality of layered stud members 36 fixedly attached thereto and projecting upwardly to be inserted through corresponding plurality of stud hole members 28 contained upon the top surface of base plate member 26. As well known in the art, each of these stud members is secured after passing through a corresponding stud hole member disposed thereupon by a suitably-sized nut member (not shown).

Those skilled in the art will appreciate that the unique crawling movement contemplated hereunder and enabled by embodiments of the present invention, exemplified in FIGS. 1-6 but not limited to this configuration, is a consequence of the cooperation manifest by spring member 32 and inherently flexible brace member 24. It will be understood that spring member 32 should preferably be interchangeable, being selected to impart prerequisite compressibility for accommodating a user or prescribed set of users characterized by a particular size range and weight range. As is known in the art, compression springs may vary in wire diameter, outer diameter, free length, end type (e.g., open ends, closed ends, open and ground ends (such as depicted in FIG. 1), and closed, squared and ground ends), total number of coils (including closed end coils and active coils), coil pitch, shape (such as cylindrical as shown in FIG. 1) as well as the wire type, such as, for example 302 stainless steel to withstand exposure to water or the like. As such, springs may be employed to provide the desired resistance to compression based on, e.g., the anticipated load created by the user, which load may vary depending on the weight of the user and the degree of force exerted on the spring by the user. The instant structure herein described enables such a selected spring member to be conveniently positioned by being inserted between upper spring retainer member 30A and lower spring retainer member 30B, and to expeditiously replace spring member 32 in situ to achieve appropriate compression-and-decompression behavior, respectively, as a function of user-attributes.

It will be understood that, to also accommodate a user's physical attributes, the height of post or column member 15 should preferably be adjusted by screwably rotating post member 16 under the influence of its corresponding thread members 18 into mated whorl hole 38 to arrive at a length thereof commensurate with, i.e., functionally proportional to, the user's height. As shown, each thread member 18 of post assembly 15 has a pair of groove members 19 symmetrically disposed thereupon. Set of wing-nuts or like fastener members 40 would then be engaged through like set of threaded holes disposed in ring member 20A with corresponding pairs of groove members 19 to enable the user to securely adjust height-positioning of hand platform 10. The present invention contemplates that, in order to achieve the prescribed prerequisite alternating upwards and downwards undulating motion taught herein, a suitably sized spring member or a pneumatically-controlled cylinder or a hydraulically-controlled cylinder or the like, may be implemented without deviating from the purposes disclosed herein.

Thus, a user would select a suitably configured spring member 32 from a set of spring members and install the selected spring member between first spring retainer member 30A and second spring retainer member 30B. Next, the user's height would be accommodated by the user rotating hand-platform 10 about threaded post member 16 to adjust hand-platform 10 to be aligned with brace support member 24 and simultaneously affixing its set vertical position by tightening a fastener member 40, exemplified herein as a bolt, to securely engage pair of groove members 19. Such adjustments to embodiments hereof limit vertical movement of hand-platform 10 and promote level rotation thereof, found to be essential for sustaining stability of a user's body at a reasonable bounding height range during crawling movement as contemplated hereunder. It should be appreciated that, once set to be compatible with a user's physical attributes, the user would emplace each hand, respectively, into hand-embracing member 5 configured as a hand-sheath—effectively functioning as a hand-shoe substantially enclosing each user's hand. Indeed, once the user's hands are emplaced therewithin, each of the pair of hand-glove members would be tightened akin to lacing or strapping a pair of shoes.

It should be understood that materials of construction of the hand-embracing hand-shoe member contemplated hereunder are essentially the same as or similar to materials of construction commonly used in the shoe manufacturing industry. As will be readily appreciated by those skilled in the art, rigid threaded post member 16 would typically be molded from suitable hard nonmetallic, plastic material or metallic material. Of course, when post member 16 is constructed from metal or in combination with metallic materials, welding or the like would be a preferred method of joinder thereof with hand platform member 10.

Focusing collectively on FIGS. 1-2, 3A-3B, and 4-6, it should be evident that support afforded by centrally disposed post member 16 is augmented by brace support member 24 disposed at one end of hand-crawler glove platform 10 and fixedly attached thereto, to provide adequate support therefor and concomitant stability thereto. More particularly, brace assembly 22 comprises an elastomeric sufficiently firm arcuate and inherently flexible brace support member 24 affixed at one end thereof to hand platform 10 and to base plate member 26 at the other, opposite end. It has been found advantageous to configure the arc described by arcuate brace member 24 having angle θ. It will be seen that arcuate angle θ has been found to function as contemplated hereunder when in the range of about 95° to about 135° to afford prerequisite compromise of stability and flexion under the influence of the intermittent upward and downward user hand-triggered whippy motion urged by compression and expansion, respectively, of spring member 32 as the user proceeds to walk or run at various speeds on the ground all fours, i.e., essentially simultaneously using both hands and both feet.

As illustrated in FIGS. 1-6. hand-crawler platform 10 comprises two embracing members 5 for securing a user's hand to this hand-crawler platform. It should be evident to those conversant in the art, that to enable a user to efficiently crawl using all-fours as disclosed herein, pairs of hand-crawler glove assemblies 5 taught hereunder are required. Thus, each user's hand, in turn, is secured prior to engaging in crawling exercises: first hand-embracing member 12 (or 13 in later figures) and second hand-embracing member 14 (or 11 in later figures)—of hand-crawler assembly 5—secure a user's hands thereinto. In particular, first hand-embracing member 12 is affixed to the front portion 10A of hand platform 10 for embracing—by strapping or like securement—the user's fingers thereto. Similarly, second hand-embracing member 14 is affixed to the rear portion 10B of hand platform 10 for embracing—by strapping or the like—the user's hand-heel and wrist adjacent thereto.

In a manner well known in the art, first hand-embracing member 12, exemplified as a strap member, and second hand-embracing member 14, also exemplified as a strap member, are secured at each respective open end by Velcro fasteners or the like to prevent the user's hands from inadvertently being dislodged from hand-crawler glove apparatus 2 during active locomotion therewith. It will be appreciated that embracing heel portion of the hand in combination with the wrist tends to prevent undue lateral wrist movement which would be detrimental to the contemplated forward or rearward locomotion taught herein. During the novel whippy forward or backward locomotion taught by the present invention, base member 26 of a corresponding hand-crawler apparatus 2 engulfing a user's left and right hand, in turn, sustains contact with the ground immediately below. As will be readily understood by those skilled in the art, this attachment may be achieved in any number of ways, including adhesion via Velcro fasteners or other commonly used suitable fastening means.

As will become evident to those skilled in the art, the present invention contemplates that embodiments of the instant hand-crawler glove apparatus 2 should be constructed with suitable materials commensurate with providing a user sufficient shock-absorption characteristics to enable various all-fours exercises to be conducted without adverse effects upon the user's back, hands, fingers, forearms, and other implicated joints and musculature that might jeopardize a user's physical well-being, but, indeed, would tend to promote healthful benefits such as weight-reduction and physical fitness. For instance, the upper surface of hand platform 10 should preferably be relatively soft to promote comfort and avoid injury to the plethora of bones, ligaments and muscles that constitute a user's hands. Accordingly, it has been found to be advantageous to construct embodiments of the present invention with a hand platform having a cork surface or with a soft gel liner commonly used for shoe repair or for shoe rebuilding.

Figure 9:
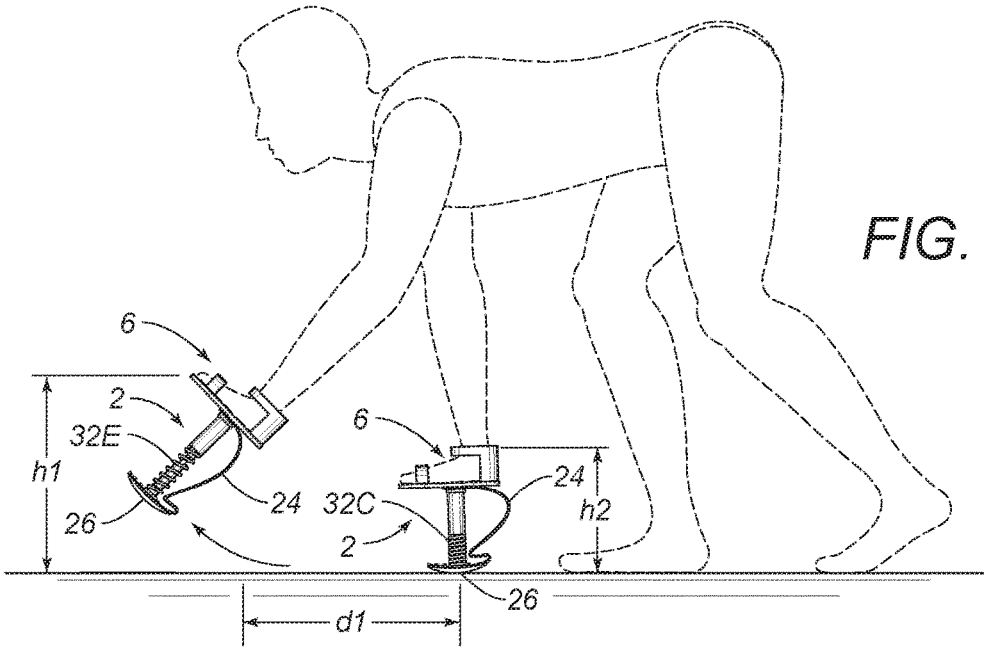
FIG. 9 depicts a simplified side perspective view of a user crawling with the embodiment depicted in FIG. 1.
Figure 10:
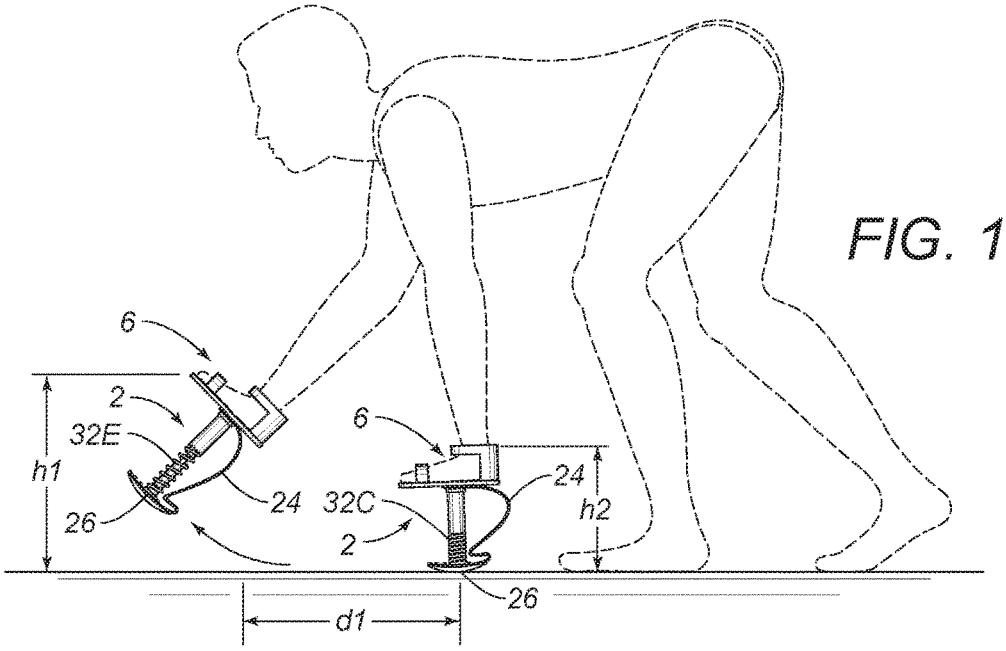
FIG. 10 depicts a simplified side perspective view of a user crawling with the embodiment depicted in FIG. 1, in a crawling position sequentially-related to the position depicted in FIG. 9.

The simplified perspective side views depicted in FIGS. 9 and 10 demonstrate the efficacy of a pair of lightweight but sturdy hand-crawler glove members used to bring crawling exercise to levels of performance heretofore unattainable and, indeed, not even contemplated by practitioners in the art. First, referring to FIG. 9, there is depicted a user having hand-crawler glove apparatus 2 releasably attached to each of his hands, leading forward locomotion with his left hand which is being propelled in an upward direction by user lifting his left and thereby urging spring 32 to its uncompressed or expanded configuration 32E with hand-crawler glove 5 securely but releasably enclosing his left hand situated in combination within left hand-crawler glove 6, while a user's self-generated downward force on his right hand urges spring 32 into compressed configuration 32C with hand-crawler glove 5 securely but releasably enclosing his right hand situated in combination within right hand-crawler glove 6.

Numeral 6 represents a user's securely-embraced hand within an implicated hand-crawler glove assembly 5. Depending upon the sequential placement of each user's hand upon the ground, one hand—the leading hand—is urged upwardly by the pressure imposed by spring 32 as it transforms from being a formerly-compressed spring 32C into a now-expanded, uncompressed spring 32E within a first combination 6 thereof.

Simultaneously, the other hand—the trailing hand—is disposed in a diametrically opposite configuration and is urged downwardly by the user's self-imposed force communicated through his implicated arm and contiguous hand upon the hand-crawler glove apparatus, thereby compressing spring 32 from expanded, uncompressed configuration 32E into compressed configuration 32C within a second combination 6 thereof.

Ergo, next, as illustrated by the user's left-and-right hand configuration depicted in FIG. 10, immediately following user's opposite left-and-right hand configuration in FIG. 9, the user's leading forward locomotion is now alternated to his right hand which is being propelled in an upward direction by the release of spring 32 urged to its uncompressed, expanded configuration 32E with hand-crawler glove 5 securely but releasably embracing his right hand situated in combination within right hand-crawler glove 6, while self-generated downward force on his left hand urges spring 32 into compressed configuration 32C with hand-crawler glove 5 securely but releasably embracing his left hand situated in combination within left hand-crawler glove 6. The whippy movement enabled by embodiments of the present invention is characterized by each hand respectively traversing distances d1 and d2 and the hand-crawler moving vertically through heights h1 and h2, as shown. It should be understood by those conversant in the art that, for a user traversing typical distances along the ground at varying pace according to such user's physical attributes and athletic condition and associated prowess, particular distances d1 and d2 vary according to normal stride lengths. It will also be understood that typical vertical heights contemplated to be manifest during use of all-fours hand-crawler embodiments of the present invention should preferably range from about ¼ inch to about ½ inch.

Figure 7:
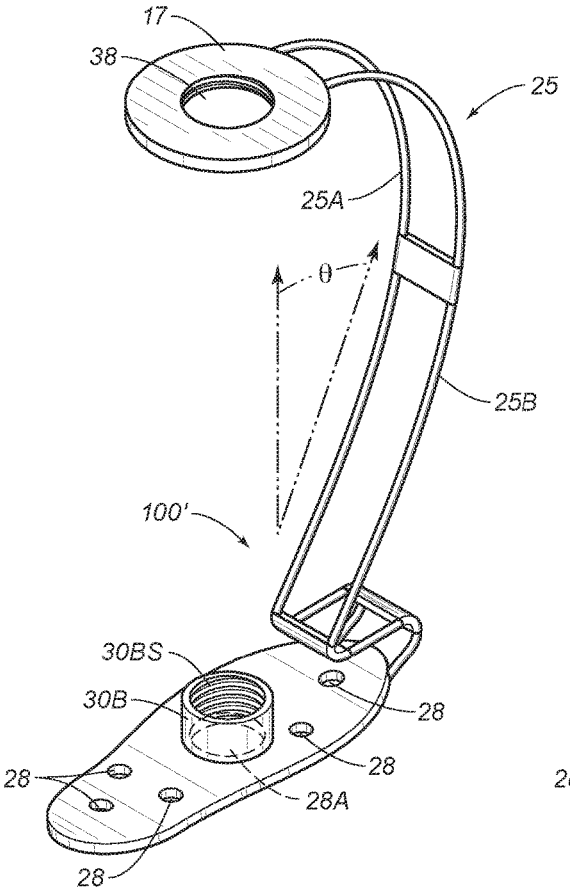
FIG. 7 depicts a frontal partial perspective view of the embodiment depicted in FIGS. 1 and 2, with a pair of rods forming an arcuate brace member.
Figure 8:
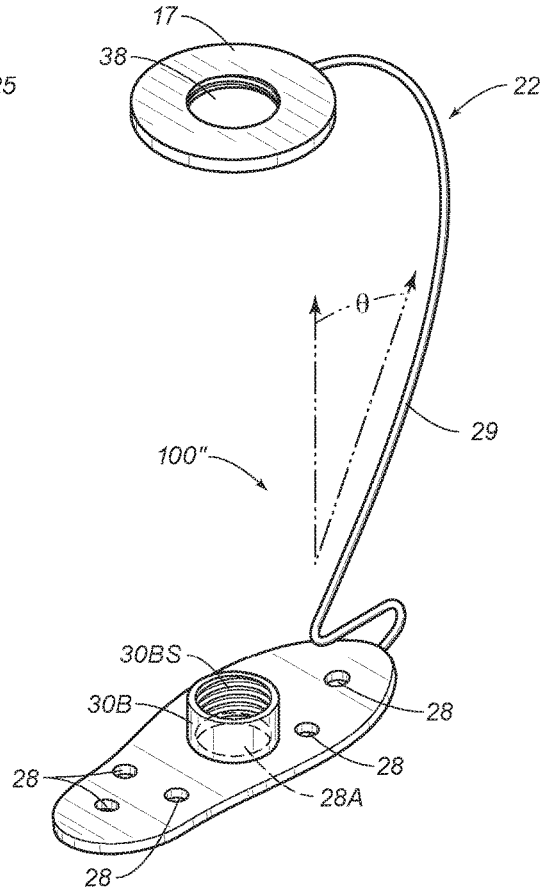
FIG. 8 depicts a frontal perspective view of the embodiment depicted in FIG. 7, with a single rod forming an arcuate brace member.

As illustrated in FIG. 7, it will also be appreciated by those conversant in the art that another embodiment of the present invention (numeral 2 depicted in FIGS. 1-6 and hereinbefore described) could be similarly configured—but with base assembly 100' comprising dual substantially congruent arcuate cylindrical rod supporting brace members 25A-B rather than just one zonal, solid brace member 24 as depicted in FIGS. 1 and 2. It will be further appreciated that FIG. 8 depicts another embodiment of the present invention with base assembly 100" comprising only one cylindrical flexible steel arcuate rod member 29 or the like typically affords more flex than both alternative arcuate brace embodiments depicted in FIGS. 1 and 7, respectively. It will be understood that a tough sufficiently flexible plastic rod member may be used in the embodiments depicted in FIGS. 7 and 8 of the present invention providing the performance contemplated hereunder is achieved.

FIGS. 19, 20, 21A and 21B depict hand-crawler glove embodiment 111 having hand-shoe assembly 5 supported therebeneath by centrally disposed post assembly 15 affixed centrally of hand platform member 10 and affixed centrally at the other, opposite end thereof to base plate member 26. As will be hereinafter described, this supporting structure enables hand-crawler glove embodiments to facilitate a user's engaging in alternating bounding and rebounding substantially vertically from the ground beneath the user's specially-gloved hands, while simultaneously being propelled forward. More particularly, it will become evident to those skilled in the art that crawling locomotion contemplated hereunder enables a user to effectuate linear movement substantially parallel to the ground via specially enabled and orchestrated crawling hand-jumping locomotion characterized by intermittently bounding and rebounding substantially vertically—essentially while synchronously progressing horizontally either in a forward or a backward direction characterized herein as whippy locomotion.

Figure 3B:
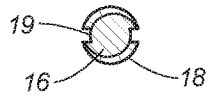
FIG. 3B depicts a cross-sectional plan view through section line FIG. 3B-FIG. 3B of the embodiment depicted in FIG. 2.
Figure 3A:
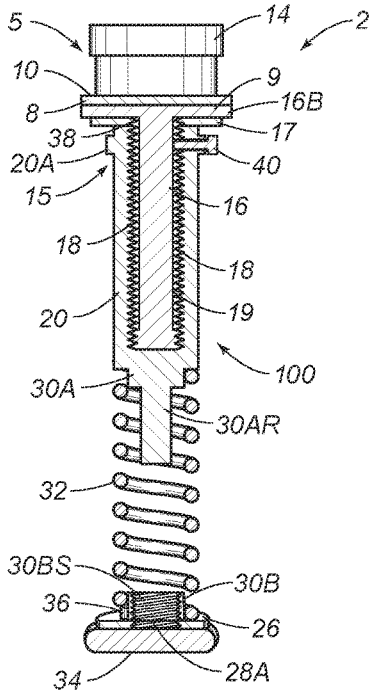
FIG. 3A depicts a frontal cross-sectional view through section line FIG. 3A-FIG. 3A depicted in FIG. 1.
Figure 5:
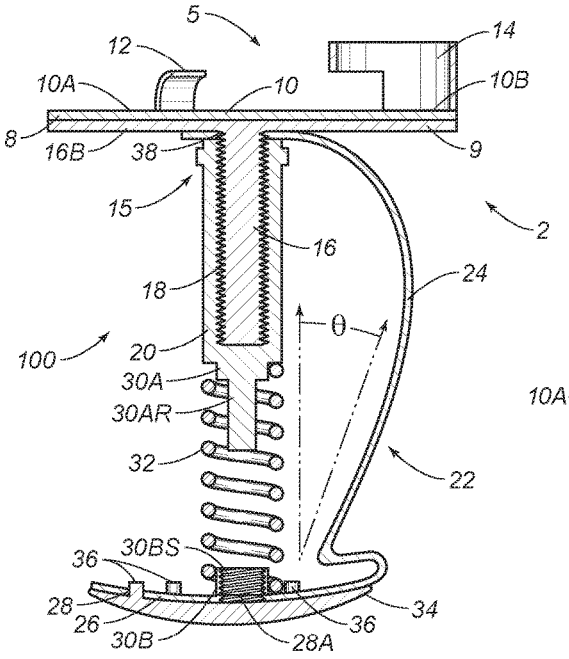
FIG. 5 depicts a cross-sectional side view through section line FIG. 5-FIG. 5 of the embodiment depicted in FIG. 1.
Figure 4:
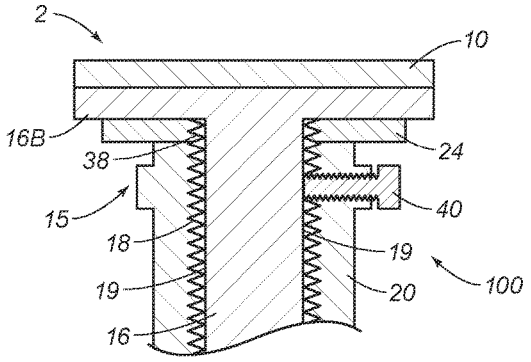
FIG. 4 depicts a cross-sectional detail view depicting the upper portion of the embodiment depicted in FIG. 3A.
Figure 6:
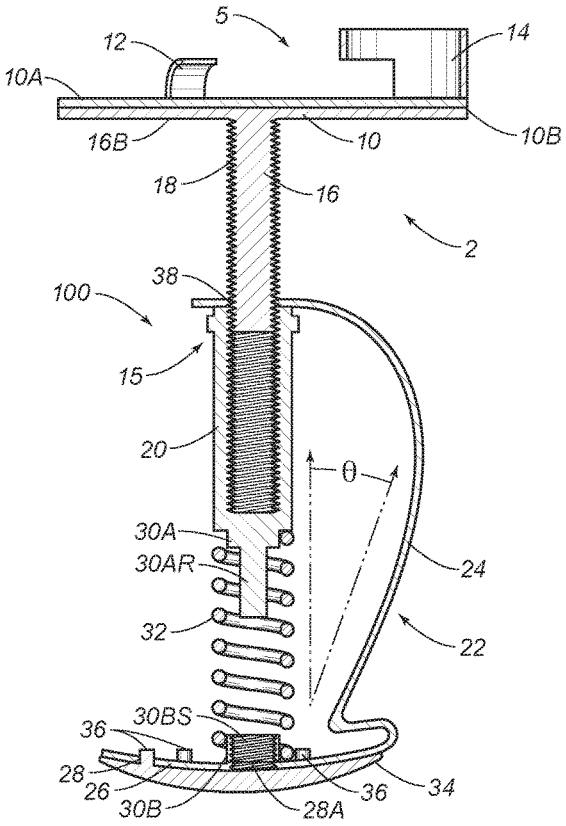
FIG. 6 depicts cross-sectional side view of the embodiment depicted in FIG. 5, with hand platform post member partially downwardly displaced compressing the spring member.
Figure 21A:
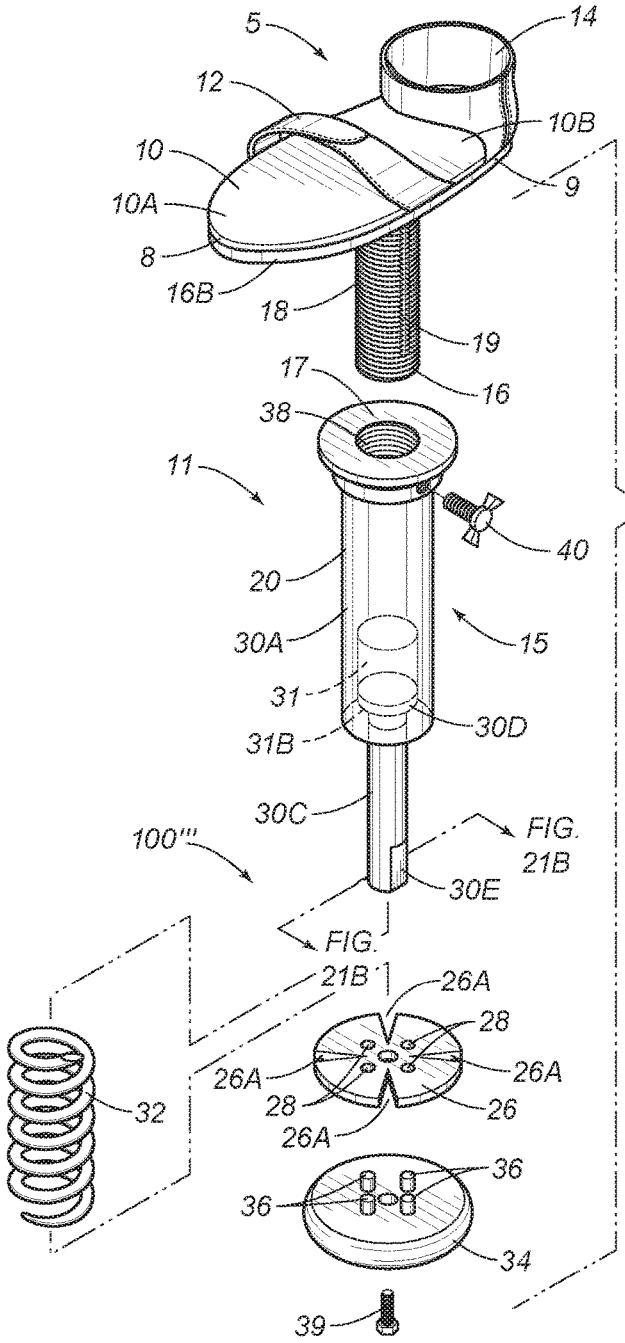
FIG. 21A depicts an exploded perspective view of the embodiment depicted in FIG. 20.

More particularly, FIGS. 19 and 20 depict a frontal perspective view of an alternative spiral-driven hand-crawler embodiment of the present invention similar to the frontal perspective views of the embodiment depicted in FIGS. 1, 2 and 3A, but with base assembly 100'" comprising only one supporting-point on the bottom of base member 26. Similarly, FIG. 21A depicts an exploded perspective view of the embodiment depicted in FIG. 19, in a manner similar to the exploded view depicted in FIG. 2. It will be appreciated that hand-crawler embodiment 111 depicted in FIGS. 19, 20 and 21A differs from hand-crawler embodiment 2 by the absence of brace assembly, 22, 25, 22, respectively, which, among other functions, affords a second point of contact with base member 26.

Thus, those skilled in the art will understand that, instead of benefiting from a second point of contact manifest by a brace assembly as taught herein, the embodiment depicted in FIGS. 19, 20 and 21A will be seen as being somewhat similar to a piston arrangement comprising single spring retainer member 30C affixed to base member 26 at its lower end thereof by a fastener member illustrated as bolt member 39. Base member 26 is preferably configured with a circular cross-section and preferably with plurality of gap members 26A to accommodate elastic distortion of base member 26 manifest during the unique whippy motion herein described. Gap members 26A are preferably configured as wedge-shaped voids cut out of base member 26. It will be seen that plurality of stud members 36 are received through like plurality of apertures 28 disposed upon base member 26.

Figure 21B:
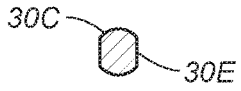
FIG. 21B depicts a cross-sectional left side view through section line FIG. 21B-FIG. 21B of the embodiment depicted in FIG. 21A.

As illustrated in FIG. 21B, it should be appreciated that, to foster stability of post assembly 15 during alternating compression and decompression of spring member 32 as herein described, pair of flat recesses 30E are disposed upon surface of opposing sides of post member 16 to facilitate securely and tightly screwably holding fastener member 39 therewithin. Top portion 30D of spring retainer member 30C is disposed within housing member 20 and has a larger diameter than the lower exposed portion of spring retainer member 30C. Shoulder members 31B are disposed at bottom portion of void space 31 within housing member 20. It will be appreciated that shoulder members 31 function as detents holding top portion 30D of piston-like spring retainer member 30C within housing member 20 to repetitively perform the expansion and compression of spring member 32 as contemplated hereunder.

To achieve the prerequisite functionality taught herein while simultaneously promoting an important lightweight objective, those skilled in the art will understand that spring retainer upper member 30A depicted in FIGS. 1, 2, 3A, 5 and 6 may be constituted with hollow construction besides solid construction. Similarly, top portion 30D of single spring retainer member 30C depicted in FIGS. 19 and 21A may be constituted with hollow construction besides solid construction to achieve the prerequisite functionality taught herein while simultaneously promoting an important lightweight objective. It should be clear to those skilled in the art that the remaining components depicted in FIGS. 19, 20, 21A and 21B are structured and function in the same manner as the like components depicted in FIGS. 1 and 2 and in FIGS. 3A and 3B.

Figure 11:
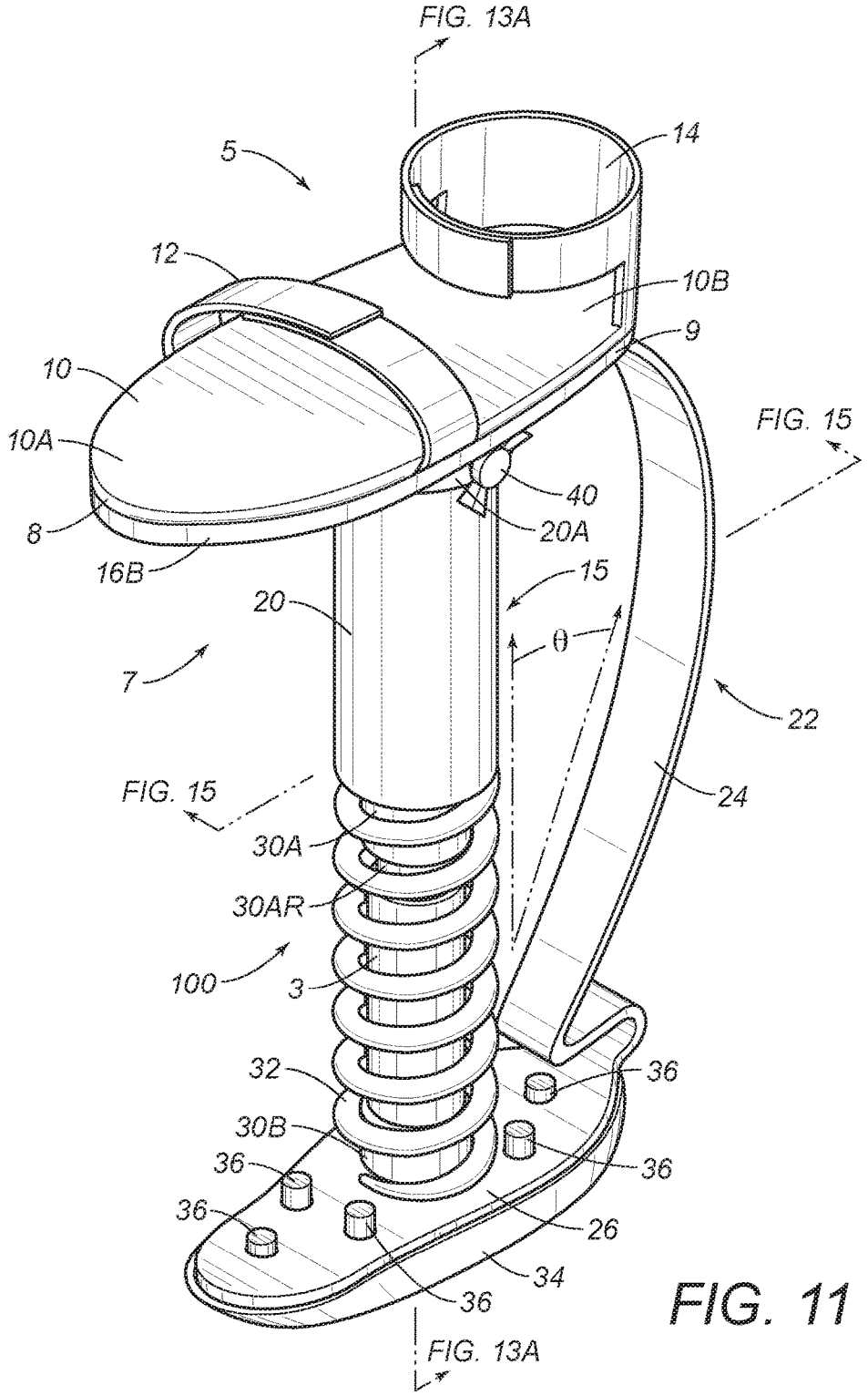
FIG. 11 depicts a frontal perspective view of an alternative spiral-driven hand-crawler embodiment depicted in FIG. 1, reinforced with a stabilizer cylinder of the present invention.
Figure 12:
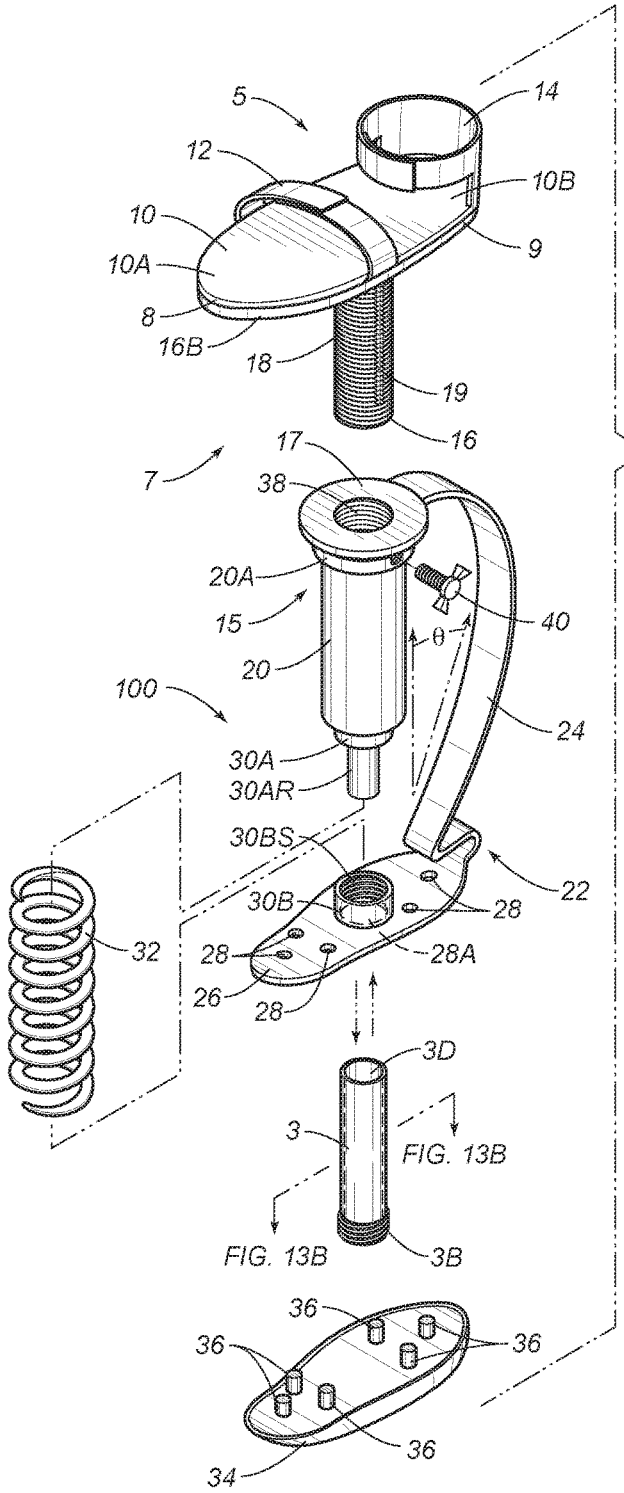
FIG. 12 depicts an exploded perspective view of the embodiment depicted in FIG. 11.

Focusing now on embodiment 7 depicted in FIGS. 11-18, there is depicted specially reinforced embodiment 7 of the embodiment depicted in FIGS. 1-8. By reconciling embodiment 2 with respect to embodiment 7 hereof, it will become evident that both have been configured to receive an optional stability supplemental support cylinder 3 which can be readily inserted through mated hole 28A in base member 26 and likewise readily removed as appropriate for a particular user or particular type of users, will be hereinafter described. FIG. 11 illustrates stabilizer support cylinder 3 in situ circumscribed by cylindrical spring member 32 situated within base assembly 100. The exploded perspective view of embodiment 7 depicted in FIG. 12 illustrates the ease with which stabilizer support cylinder 3 is preferably either screwably emplaced or screwably replaced through hole 28A with cooperation between stability cylinder whorl 3B and internal cylindrical aperture whorl 30BS and secured therein by stability cylinder retainer 30AR. Thus, this stability support cylinder is disposed annularly between post member 16 and spring member 32.

Figure 13B:
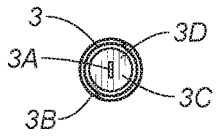
FIG. 13B depicts a cross-sectional plan view through section line FIG. 13B-FIG. 13B of the embodiment depicted in FIG. 12.
Figure 13A:
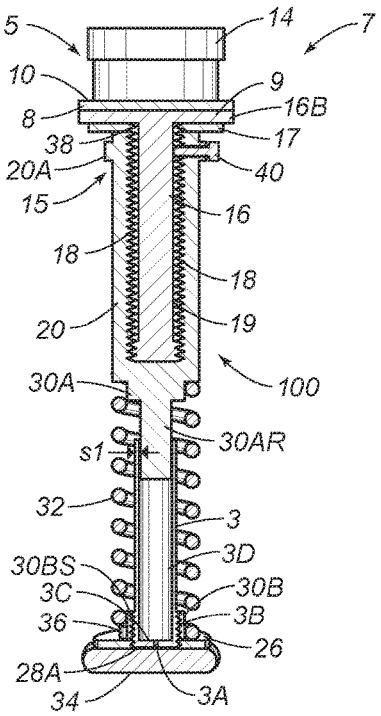
FIG. 13A depicts a frontal cross-sectional view through section line FIG. 13A-FIG. 13A depicted in FIG. 11.
Figure 14:
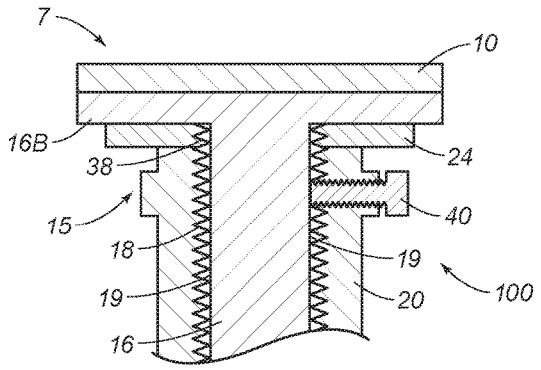
FIG. 14 depicts a cross-sectional detail view depicting the upper portion of the embodiment depicted in FIG. 13A.
Figure 15:
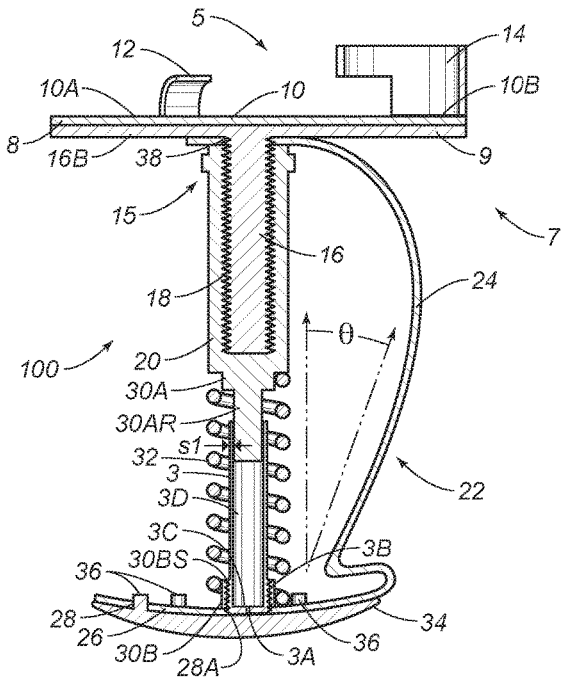
FIG. 15 depicts a cross-sectional side view through section line FIG. 15-FIG. 15 of the embodiment depicted in FIG. 11.
Figure 16:
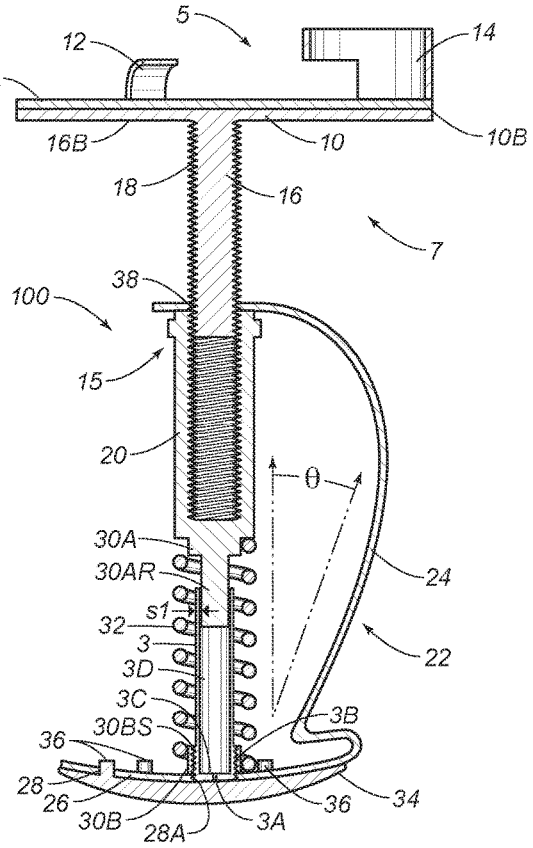
FIG. 16 depicts cross-sectional side view of the embodiment depicted in FIG. 15, with hand platform post member partially downwardly displaced compressing the spring member.
Figure 17:
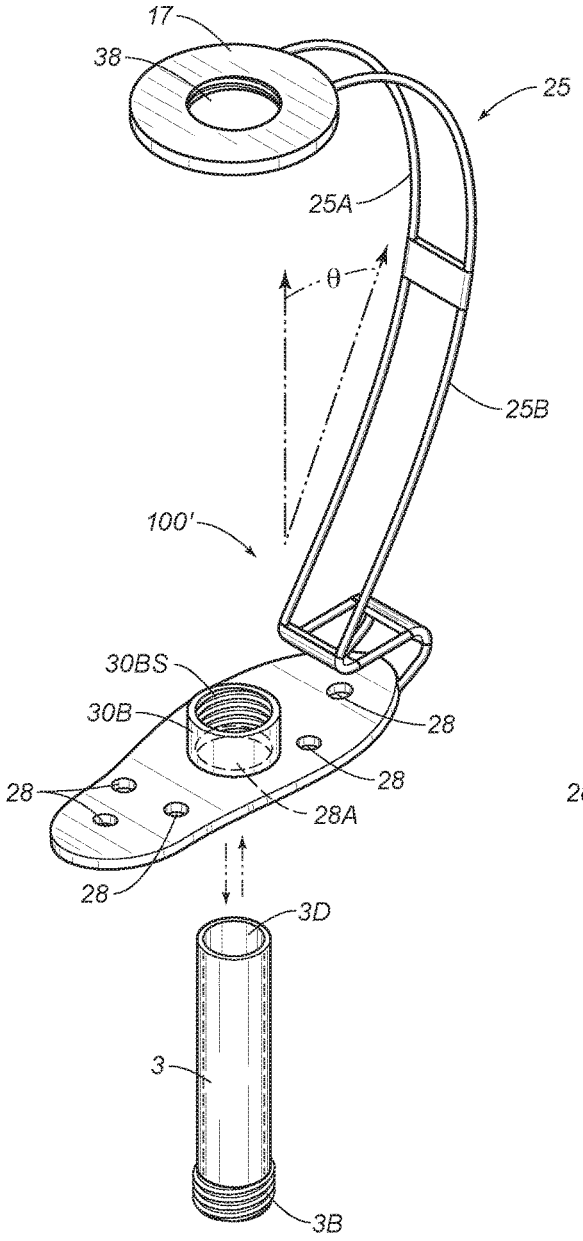
FIG. 17 depicts a frontal partial perspective view of the embodiment depicted in FIGS. 11 and 12, with a pair of rods forming an arcuate brace member, and illustrating insertion and removal of a stabilizer cylinder of the present invention.
Figure 18:
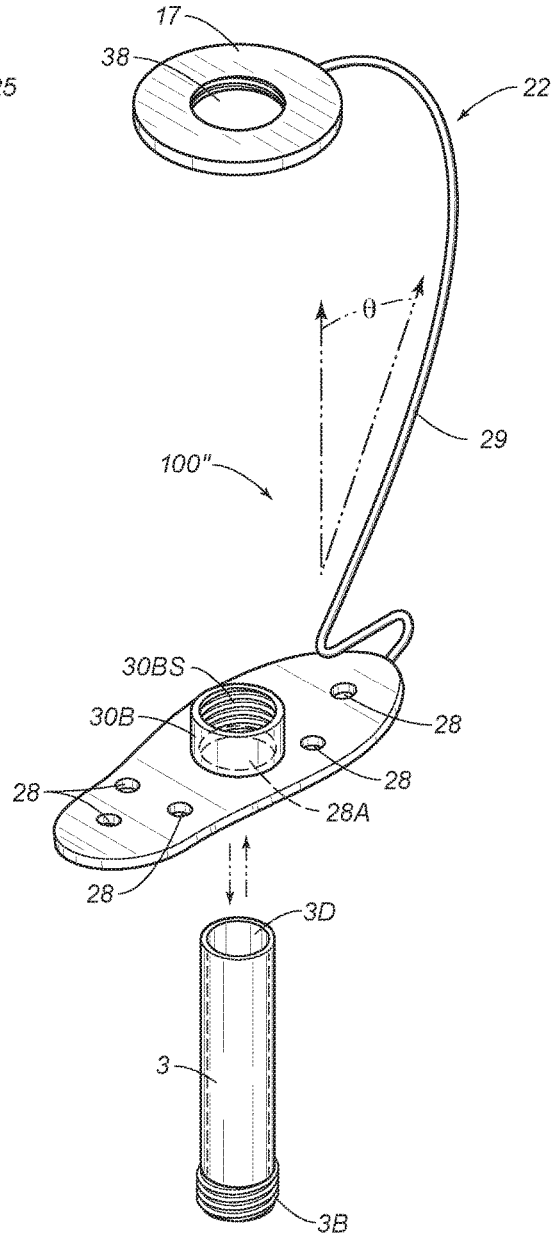
FIG. 18 depicts a frontal perspective view of the embodiment depicted in FIG. 17, with a single rod forming an arcuate brace member.

This attachment and detachment relationship is illustrated in the frontal cross-sectional view in FIG. 13A and the cross-sectional plan view in FIG. 13B. Lower spring retainer member 30B is interconnected with base member 26 either by molding or welding as a function of the material of construction, i.e., either suitable plastic or metal, respectively. It should also be understood that gap s1 between stabilizer cylinder retainer 30AR and bore hole 3D is configured to accommodate moderate horizontal deflection flexibility during whippy locomotion to militate against undermining the crucial stability of embodiments hereof that could jeopardize the user's safety and well-being during whippy locomotion.

Thus, as clearly depicted in FIGS. 12-18, stability cylinder 3 would be optionally emplaced within base assembly 100 of structurally-reinforced embodiment 7 wherein stability cylinder bottom portion 3C is securably attached to base member 26 after being adjusted by a screwdriver having access thereto through slit member 3A in hand platform 10. It should be evident that FIG. 13B illustrates the interrelationship between slit member 3A in stability support cylinder 3 for accommodating insertion of a screwdriver for securing the cylinder bottom 3C to the external threaded whorl 3B.

Figure 22A:
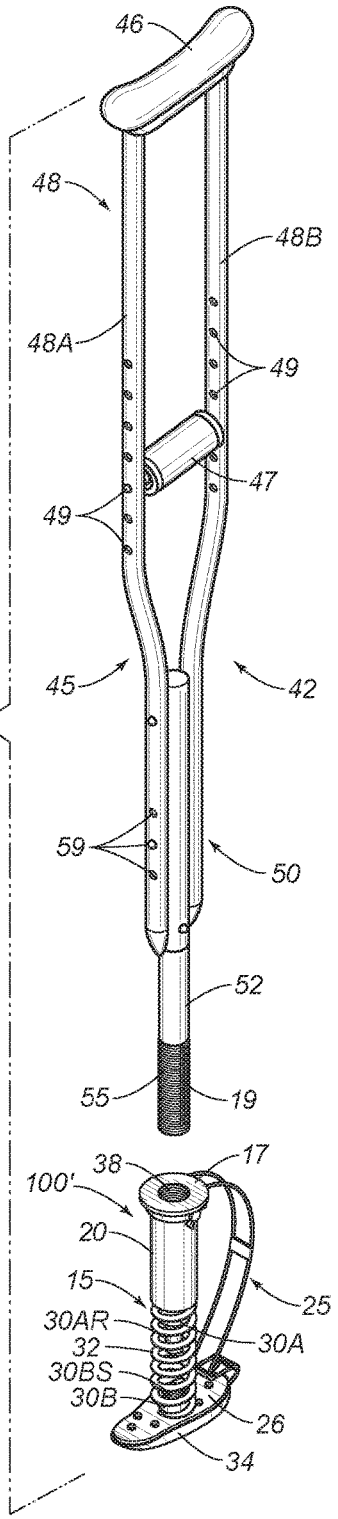
FIG. 22A depicts a frontal partial perspective view of an alternative spiral-driven embodiment of the present invention adapted to accommodate a crutch, and with a pair of rods forming an arcuate brace member.

Now focusing on FIG. 22A, there is seen a frontal perspective view of a dual arcuate brace member embodiment of the present invention 42 comprising base assembly 100' configured to be adjoined with a crutch 45 rather than a user's hand for achieving the novel mode of locomotion taught hereunder. More particularly, as shown, conventional crutch 45 is configured to be screwably received within threaded whorl hole 38 as hereinbefore described. Threads 55 of crutch post member 52 are received by corresponding threads within whorl hole 38. Crutch 45 is shown comprising conventional components well known in the art, including arm pit pad 46 disposed in a transversal relationship with frame 48 constituting first frame portion 48A and second frame portion 48B. Conventional crutch hand grip 47 would be appropriately emplaced within a pair of plurality of symmetrically disposed holes 49 to be commensurate with the user's height. Similarly, crutch post member 52 would be appropriately emplaced in a manner common in the art within a pair of plurality of symmetrically disposed holes to be commensurate with the user's height and other relevant attributes.

It should be understood that, regardless of whether a user walks with a single crutch or with a pair of crutches, crutch embodiment 42 would be adjusted to be compatible with the length of the user's arms (not shown) and the length of the user's legs (not shown). Crutch embodiment 42 comprises frame member 48 having first portion thereof 48A and second portion thereof 48B with horizontal soft hand-grip member 47 disposed as a transversal therebetween. Each of first portion 48A of frame 48 and second portion 48B of frame 48 include two sets of congruent pairs of holes 49 and 59, respectively, along the length thereof as shown. Cushioned hand-grip 47 is situated at an appropriate height by its opposite ends being emplaced in a commensurate pair of holes 49. Similarly, pole member 52 is situated at an appropriate height by its opposite ends being suitably emplaced in a commensurate pair of holes 59. Thus, adjustment of pole member 52 within congruent pairs of holes 59 is functionally related to setting appropriate vertical distance from the bottom adjustable portion 50 of specially-configured crutch member 42 to top portion thereof at pad member 46 would be adjusted by being inserted into a position of post member 52 by emplacing a pair of conventional fasteners (not shown) into identically positioned holes disposed on each of lower portion of corresponding pair of frame portion 48A and 48B. It should be understood that, after these height adjustments have been made to accommodate a user's physical arm and leg physical attributes, threaded portion 55 of pole member 52 of crutch embodiment 42 would be conjoined with base assembly 100' by being screwably emplaced within whirl hole 38 of cylindrical housing member 20, wherein the distance from base member 34 to hand-grip 47 and arm-pit pad 46, respectively, are commensurate with the user's corresponding arm and leg physical attributes. Then, when a user walks with either one or two crutch embodiments hereof, depending upon whether one or two crutches are needed for support and the like, the vertical spring locomotion as hereinbefore described tends to promote his physical movement along the ground below concomitant with the several benefits hereinbefore elucidated.

Figure 22B:
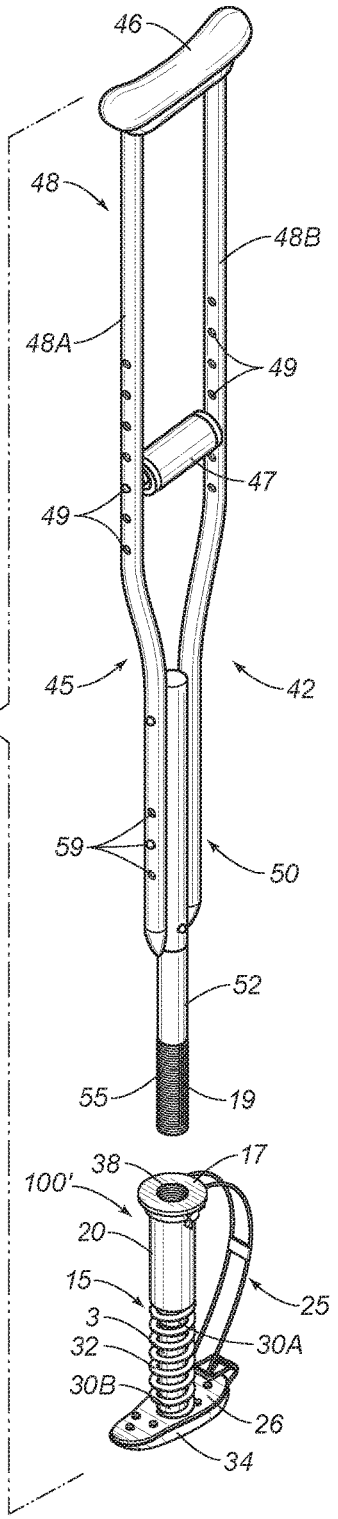
FIG. 22B depicts a frontal partial perspective view of the spiral-driven crutch embodiment depicted in FIG. 22A, reinforced with a stabilizer cylinder of the present invention.

Those skilled in the art will readily appreciate that FIG. 22B corresponds to a frontal perspective view of the dual arcuate brace member embodiment depicted in FIG. 22A, but comprising a supplemental stabilizer support cylinder as hereinbefore described. Ergo, it will be readily understood that this stabilizer cylinder-reinforced crutch embodiment contemplated hereunder performs with the same feature set and functionality as the unreinforced embodiment thereof depicted in FIG. 22A—but inherently affording substantially greater stability and safety factor than would otherwise be achievable especially under exigent circumstances implicating significantly inhibited crutch-constrained locomotion.

Other variations and modifications will, of course, become apparent from a consideration of the structures and techniques hereinbefore described and depicted. For instance, it has been found that various embodiments of the human hand-crawling and bounding apparatus taught herein may be effectively used with a hand-platform comprising only a front hand-embracing member. That is, it has been found that a user may achieve the whippy locomotion herein described in the absence of such user securing the rear heel hand-portion into a rear hand-embracing member. Indeed, it has been found that, if a user has achieved a sufficient all-fours locomotion level of skill then there may be sufficient equilibrium associated with use of the instant apparatus that supplemental stability provided by a rear hand-embracing member or even a supplemental stability cylinder would not be necessary.

As another example of the versatility of embodiments of the present invention, it has been found to be feasible and, indeed, advantageous not only for users striving to effectuate walking or jogging or running or even jumping exercise routines to sustain physical fitness and good health, but also for athletes and the like to augment normal training protocol by availing themselves of additional thrust and momentum attained by the spiral-driven apparatus disclosed herein. Referring collectively to the simplified illustrations depicted in FIGS. 23 and 24, there is seen, similar to the illustrations depicted in FIGS. 9 and 10, a user engaging in a walking sequence while invoking the benefits imparted by the present invention. First, referring to FIG. 23, there is depicted a user having foot-bounding glove apparatus 2' releasably attached to each of his feet, leading forward locomotion with his left foot which is being propelled in an upward direction by user lifting his left and thereby urging spring 32 to its uncompressed or expanded configuration 32E' with the foot-bounding glove securely but releasably enclosing his left foot situated in combination within left foot-bounding glove 6, while a user's self-generated downward force on his right foot urges spring 32' into compressed configuration 32C' with the foot-bounding glove securely but releasably enclosing his right foot situated in combination within right foot-bounding glove 6'.

It should be understood that numeral 6' represents a user's securely-embraced foot within an implicated foot-bounding glove assembly. Depending upon the sequential placement of each user's foot upon the ground, one foot—the leading foot—is urged upwardly by the pressure imposed by spring 32' as it transforms from being a formerly-compressed spring 32C' into a now-expanded, uncompressed spring 32E' within a first combination 6' thereof. Simultaneously, the other foot—the trailing foot—is disposed in a diametrically opposite configuration and is urged downwardly by the user's self-imposed force communicated through his implicated leg and contiguous foot upon the foot-bounding glove apparatus, thereby compressing spring 32' from expanded, uncompressed configuration 32E' into compressed configuration 32C' within a second combination 6' thereof.

Figure 23:
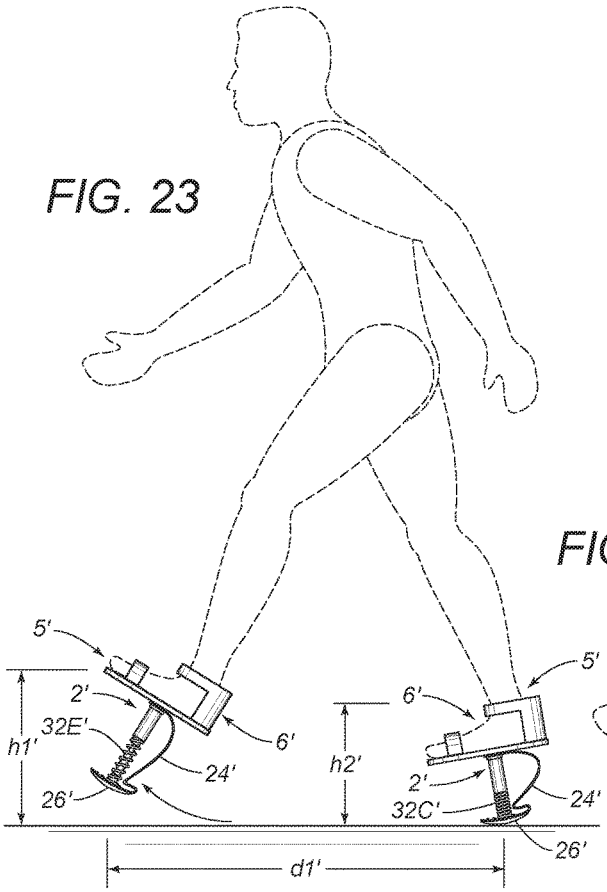
FIG. 23 depicts a simplified side perspective view of a user engaging in power-walking with the embodiment depicted in FIG. 1.
Figure 24:
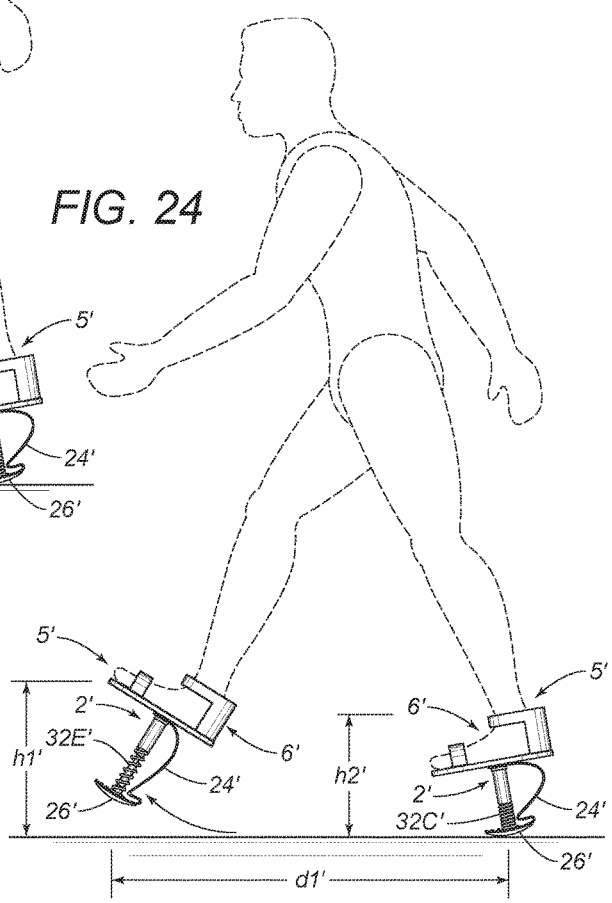
FIG. 24 depicts a simplified side perspective view of a user engaging in power-walking with the embodiment depicted in FIG. 1, in a walking position sequentially-related to the position depicted in FIG. 23.
Figure 25:
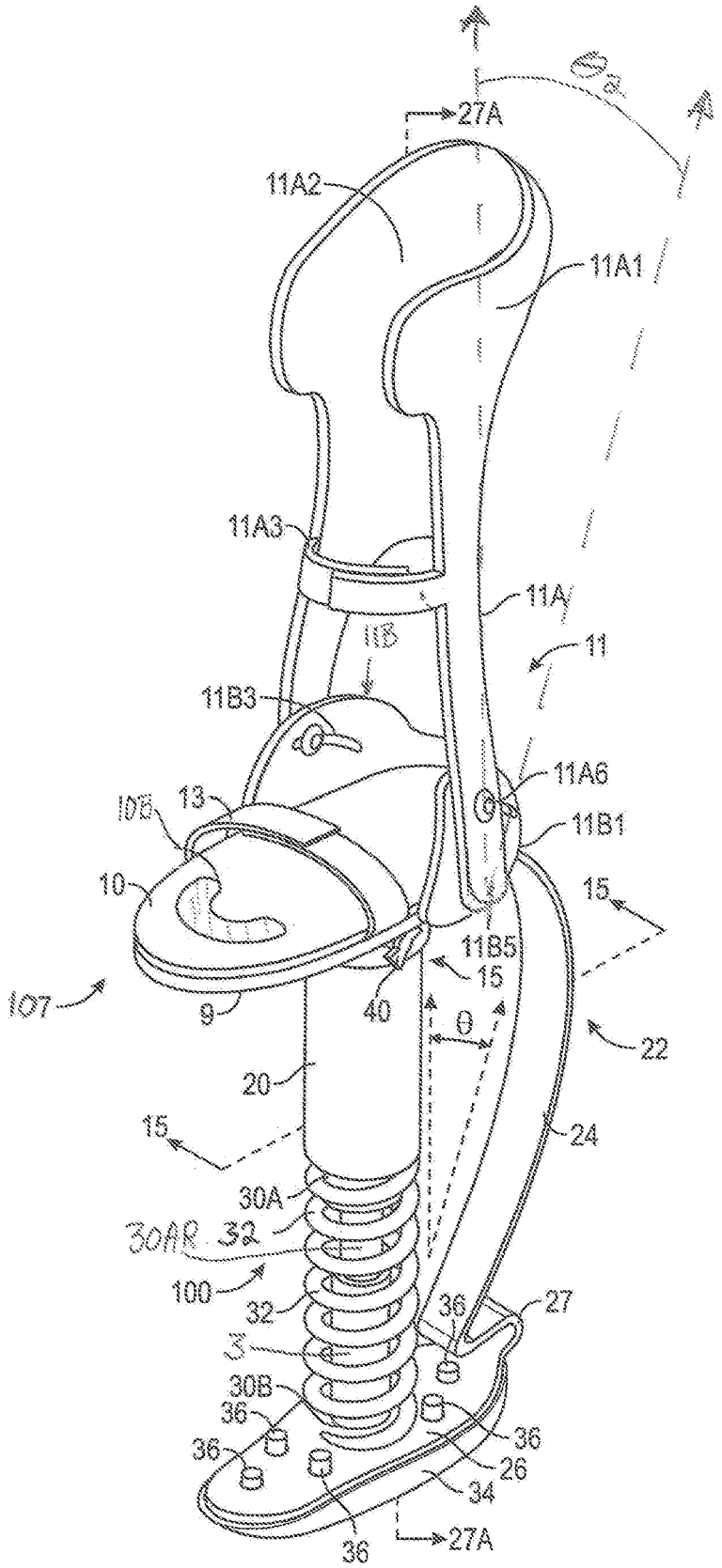
FIG. 25 depicts a frontal perspective view of another hand-crawler embodiment of the present invention with a flat zonal arcuate brace member, having two supporting-points on the bottom of the base, and another glove apparatus.
Figure 26:
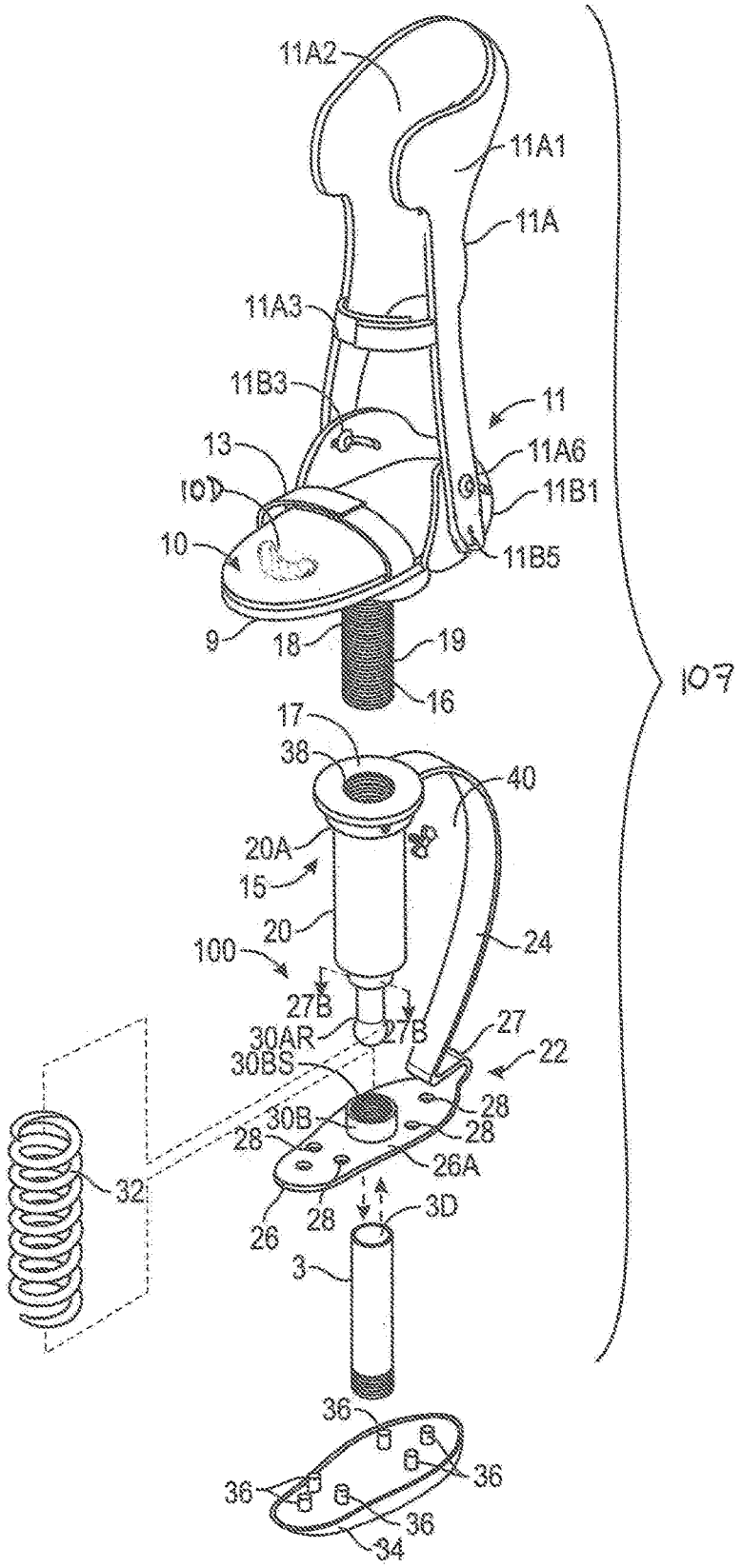
FIG. 26 depicts an exploded perspective view of the embodiment depicted in FIG. 25.
Figure 27B:
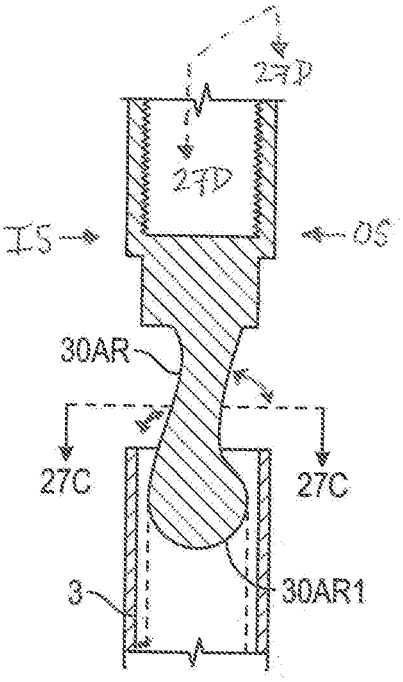
FIG. 27B depicts a cross-sectional front plan view through section line 27B-27B of the embodiment depicted in FIG. 26 intended for use on the embodiment worn on the left hand of a user to reduce inward pivoting (toward the opposite hand or toward the inside IS of the device) of the internal stabilizer cylinder retainer in the direction of the right hand while permitting outward pivoting toward the outside OS of the device, and front-to-back pivoting toward the front side/end FS or backside rear end BS of the device.
Figure 27C:
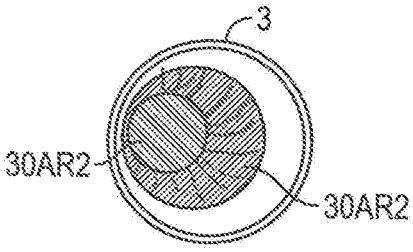
FIG. 27C depicts a cross-sectional view through section line 27C-27C of the embodiment depicted in FIG. 27B.
Figure 27D:
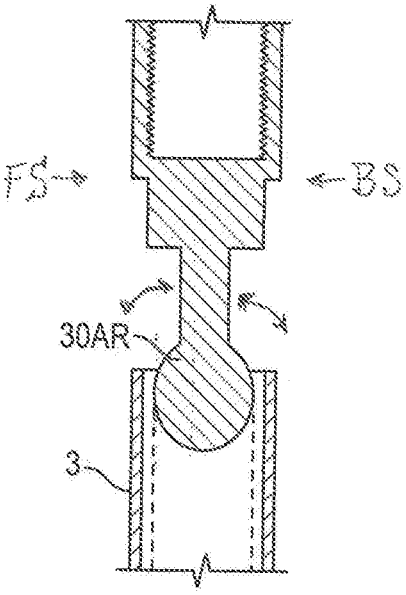
FIG. 27D depicts a cross-sectional view through section line 27C-27C of the embodiment depicted in FIG. 27B.
Figure 27A:
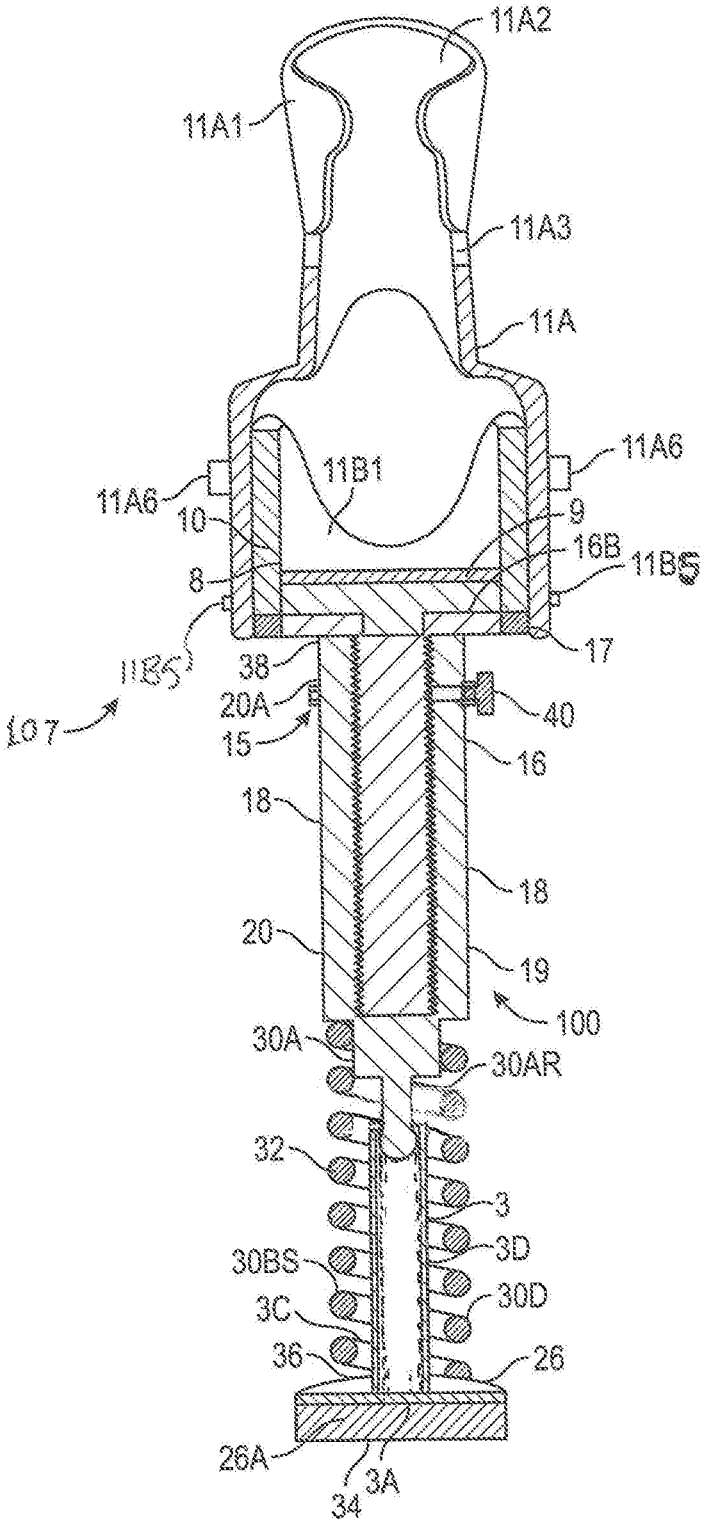
FIG. 27A depicts a frontal cross-sectional view through section line 27A-27A depicted in FIG. 25.
Figure 28:
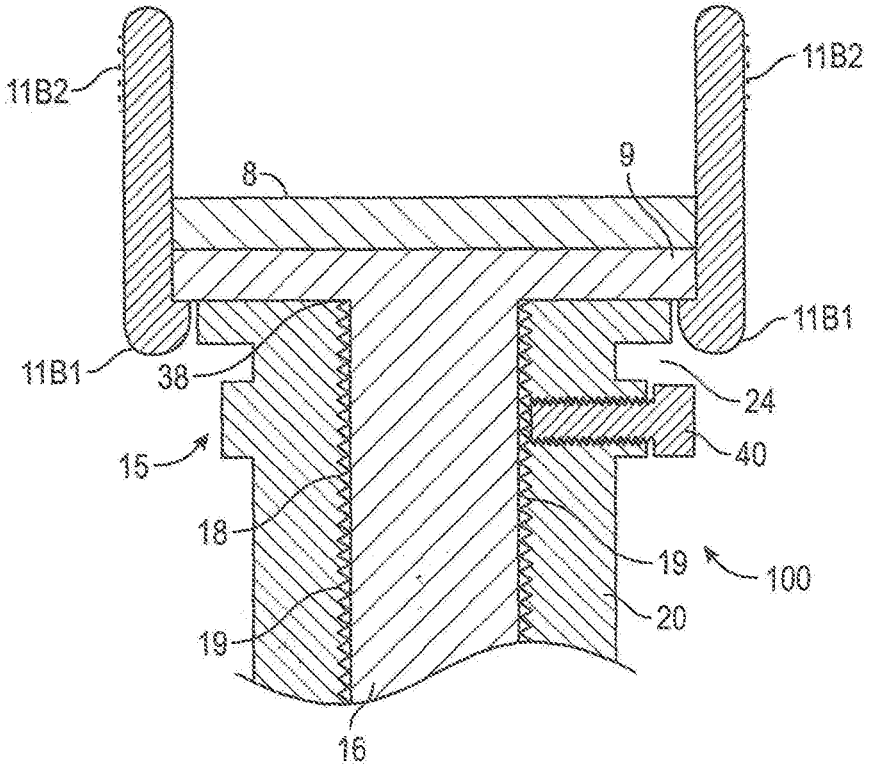
FIG. 28 depicts a cross-sectional detail view depicting the upper portion of the embodiment depicted in FIG. 27A.
Figure 29:
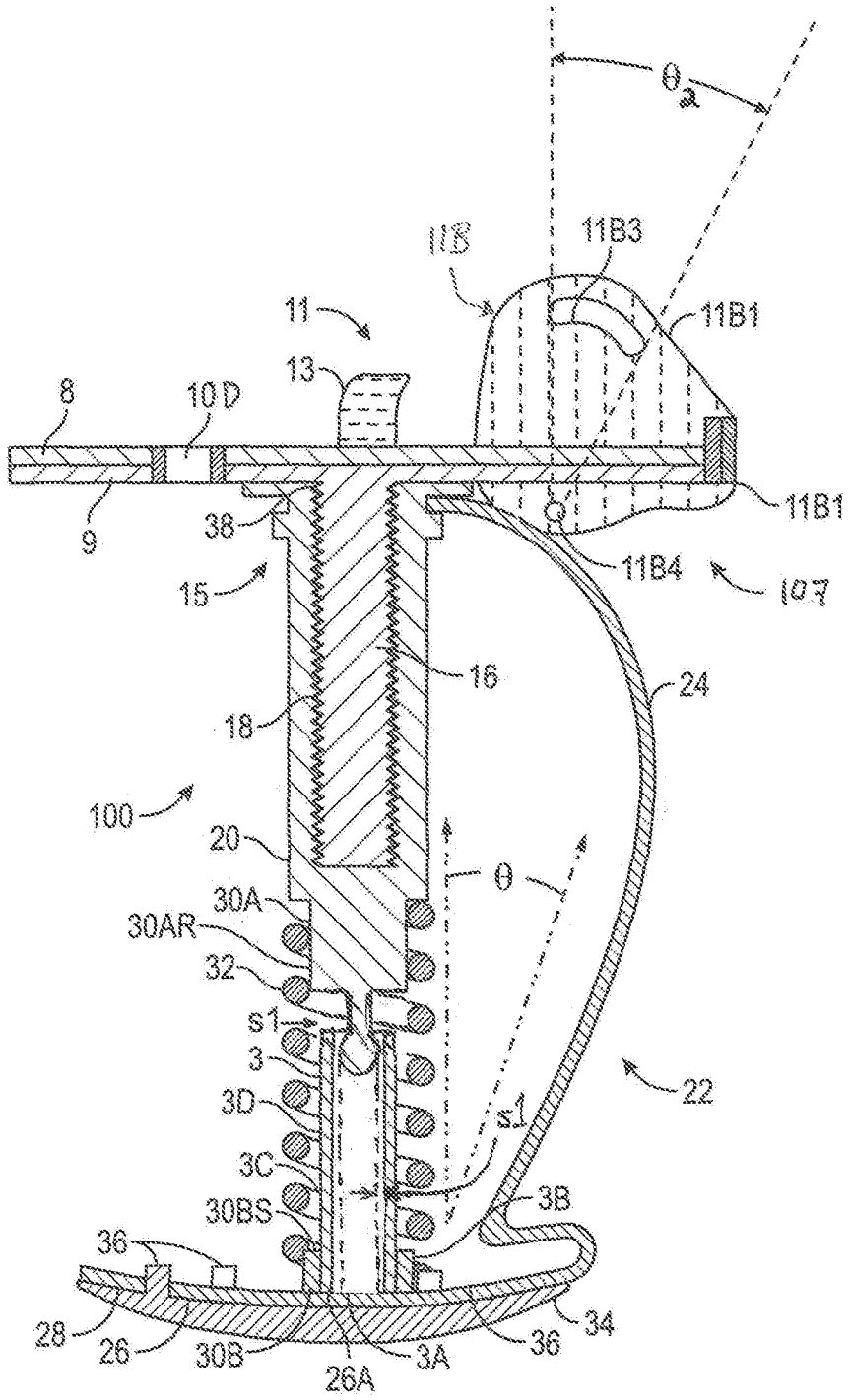
FIG. 29 depicts a cross-sectional side view through section line 15-15 of the embodiment depicted in FIG. 25.
Figure 30:
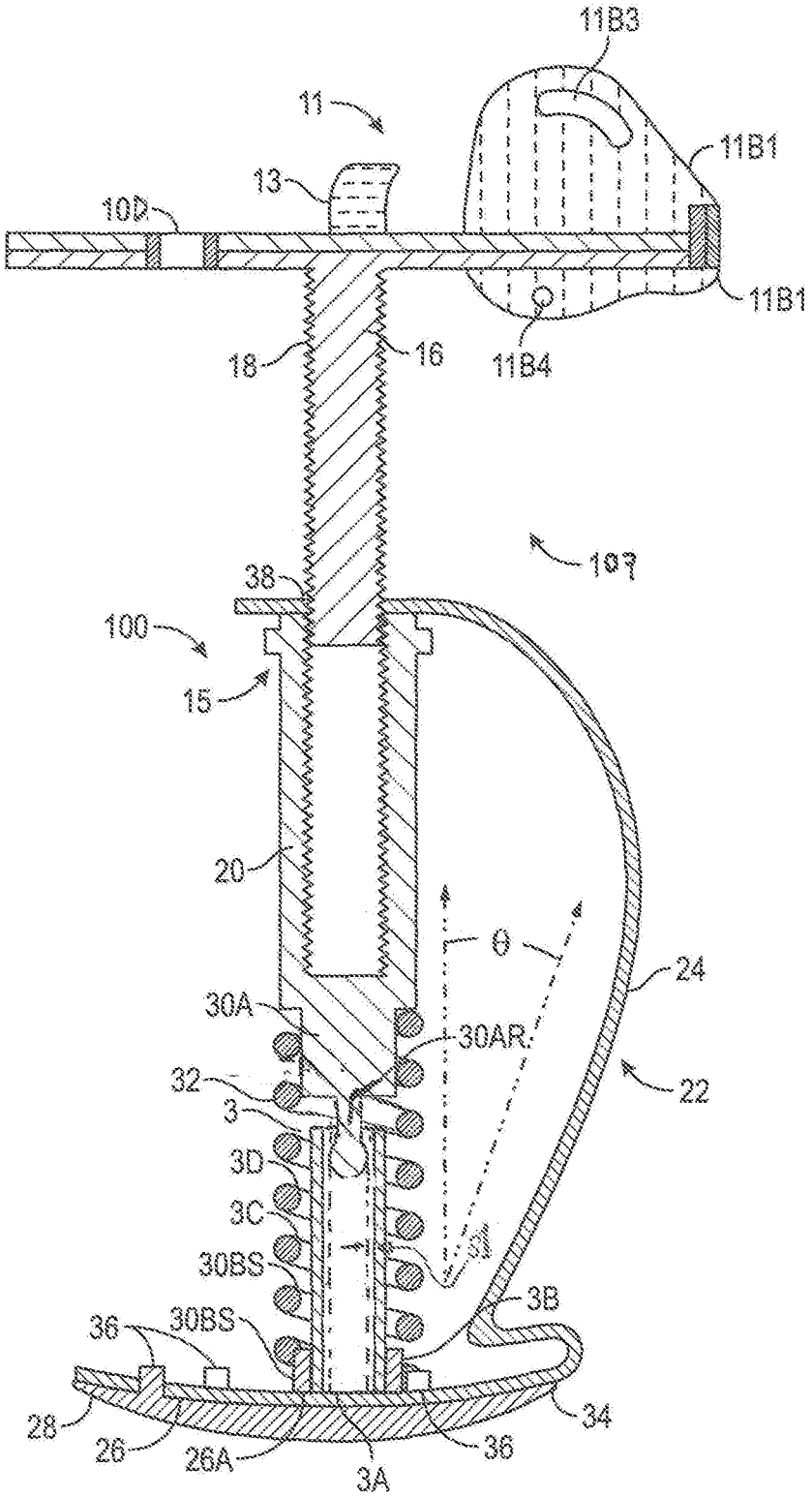
FIG. 30 depicts the cross-sectional side view of the embodiment depicted in FIG. 29 with the hand-crawler post member extended outwardly to extend the its length.
Figure 31:
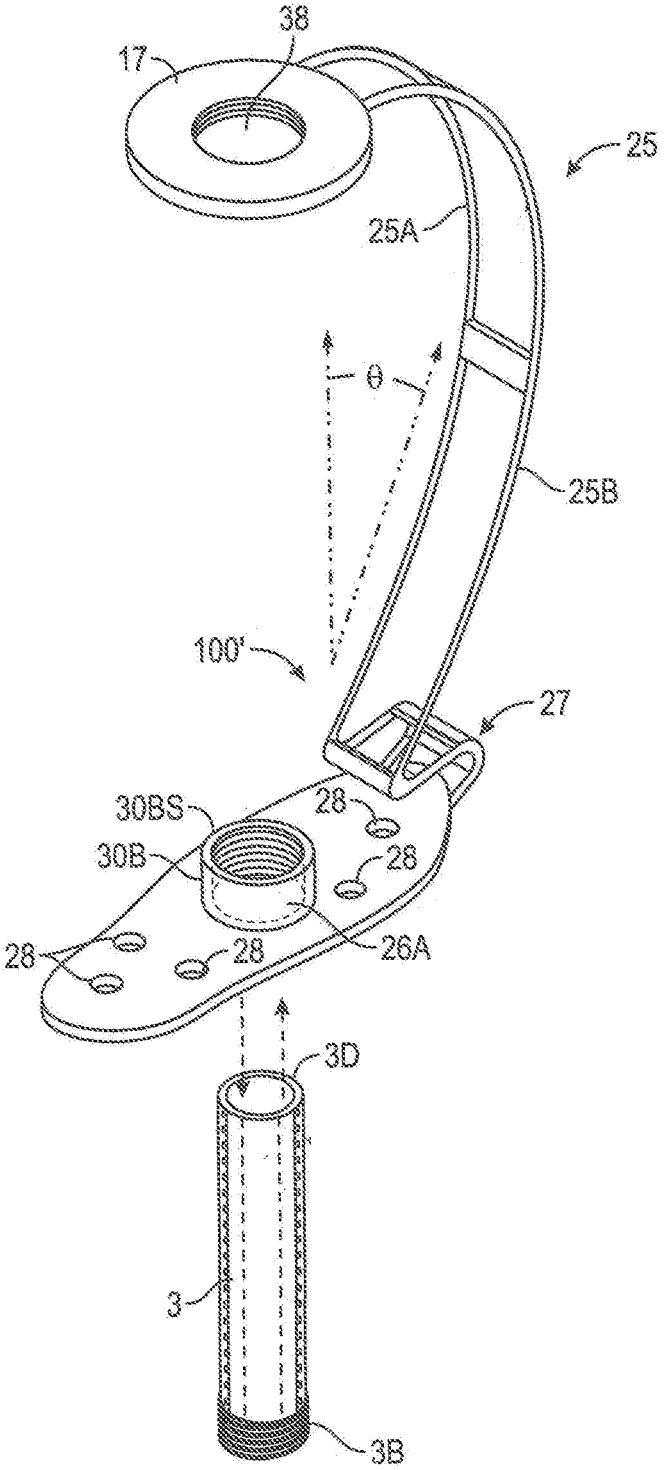
FIG. 31 depicts a frontal partial perspective view of the embodiment depicted in FIGS. 25 and 26, with a pair of rods forming an arcuate brace member, and illustrating insertion and removal of a stabilizer cylinder of the present invention.

Ergo, next, as illustrated by the user's left-and-right foot configuration depicted in FIG. 24, immediately following user's opposite left-and-right foot configuration in FIG. 23, the user's leading forward locomotion is now alternated to his right foot which is being propelled in an upward direction by the release of spring 32' urged to its uncompressed, expanded configuration 32E' with foot-bounding glove 5' securely but releasably embracing his right foot situated in combination within right foot-bounding glove 6', while self-generated downward force on his left foot urges spring 32' into compressed configuration 32C' with foot-bounding glove 5' securely but releasably embracing his left foot situated in combination within left foot-bounding glove 6'.

The whippy movement enabled by embodiments of the present invention is characterized by each foot respectively traversing distances d1' and d2' and the foot-bounding apparatus moving vertically through heights h1' and h2', as shown. It should be understood by those conversant in the art that, for a user traversing typical distances along the ground at varying pace according to such user's physical attributes and athletic condition and associated prowess, particular distances d1' and d2' vary according to normal stride lengths. It will also be understood that typical vertical heights contemplated to be manifest during use of pair of foot-bounding embodiments of the present invention should preferably range from about ¼ inch to about ½ inch.

Referring to the above disclosure, the referenced figures and element numbering, numerous modifications can be made to the hand-crawling devices disclosed herein. Referring now to FIGS. 25, 26, 27A, 27B, 27C, 28, 29, 30, 31, 32A, 32B, 34, 35A, 35B, 36, 37A and 37B (and with reference to like element numbering from prior figures) there are shown depictions or features of another hand-crawling device 107. This embodiment 107 is similar to that shown in connection with FIGS. 11-17, some of differences being directed to a different hand-glove assembly 11, and a different internal stabilizer cylinder retainer member 30AR as will be described below.

The new hand-glove assembly design 11 comprises a finger slot 10D to permit the user to curl one or more fingers through the slot to facilitate the user's grip. The hand embracing member 14 (see FIG. 11) has been modified to include a forearm bracket member 11, 11A extending upwardly from the planar hand platform member 10. In this embodiment, the planar hand platform 10 has a heel section 11B1 extending around the back and side edges of the platform 10 in the rear portion 10B of the platform. This thick parapet substrate 11B1 also provides a place for securing the forearm bracket to the substrate 11B1. The forearm brace HA comprises a curved brace section 11A1 for interacting and supporting the back of a user's forearm. In one embodiment, the forearm bracket 11A comprises at its lower end two opposed leg members 11A having a lower section for attaching fixedly or pivotally to the outer sides of the planar hand platform heel section 11B1 and a middle section that curves inwardly and then upwardly to an upper section 11A1. As will be understood by those having the benefit of this disclosure, the exact shape of the brace member 11 can be tailored to ergonomically fit the user's forearm, or to provide for adjustability/tightening to permit tailoring the fit to the user. As will also be understood by those having the benefit of the present disclosure, suitable materials (metals, plastics, synthetics, composites) can be used for the brace 11 to provide the desired level of strength, structural support, flexibility and comfort. Padding (not shown) can also be employed in those areas of the bracket that contact the user's hand, wrist and forearm.

In one embodiment, this section 11A1 also has tabs or ear sections 11A2 extending around to the front of the user's forearm and can be shaped in an ergonomic fashion to surround or partially surround the user's forearm. The bracket may also comprise one or more straps 11A3 or other securing mechanisms (e.g., buckles, laces, hook and loop fasteners and the like) to assist in securing the forearm within the forearm brace 11A.

In this embodiment, the bracket 11A has two opposed legs that are pivotally attached to the substrate 11B1 via an aperture 11B4 in the substrate and corresponding aperture or axis point 11B5 of the bracket 11A. The substrate 11B1 also contains opposed guide slots 11B3 that may receive a securing nut 11A6 to secure the bracket's angular movement along the path of the slot 11B3. As will be appreciated, when the lower ends of the bracket legs are pivotally attached to substrate 11B1 at axis 11B5, the bracket is therefore capable of rotating forward and backward about the pivot axis 11B5. Slot 11B3 provides forward and rearward stops to guide and confine and guide the radius of travel about angle $\theta_2$. This permits the user to adjust the angle of the wrist relative to the vertical and then to secure or fix the bracket to remain at that angle during use. In one embodiment, the angle $\theta_2$ ranges from about 55° to 90°. Forearm-bracket member 11A is an angle adjustable component used for receiving the user's forearm to prevent wrist from waggle while user is doing crawling exercises, the support being provided by the upper straps 11A3 and the curving or contoured braces 11A2. In connection with the embodiment 107*a* shown in FIG. 48, the inside edge of the planar hand platform 10 can also contain a contoured indentation 10E to accommodate the user's thumb and to enhance the user's grip.

To enhance the locking of the bracket angle $\theta_2$, the assembly of angle adjustable forearm-brackets consists of a group of angle-lock assembly including raised radical cogging members 11A4, 11B2, slots 11B3, bolt members 11A6 and thick parapet assembly 11B1, axis assembly, which allows angle of forearm-bracket changing and then fixing position to a specific angle chosen by user. The raised radial cogging members 11A4, 11B2 are used for reinforcing the stability of the forearm bracket 11A at a certain position by tightening hand-bolts 11A6, which have a same radius and a same central angle on axis 11B5. The thick parapet member 11B1 is used for supporting forearm-bracket with its cogging members 11B2 and slot members 11B3, which is integrated with the hand platform 10 by molding or 3D printing. Tough, tenacious materials should be feasible.

Curving Brace 11A1 is used primarily for embracing upper portion of user's forearm. If rear strap 11A3 for forearm is not enough in practical usage, additional strap(s) for the wrist could be added.

Figure 32A:
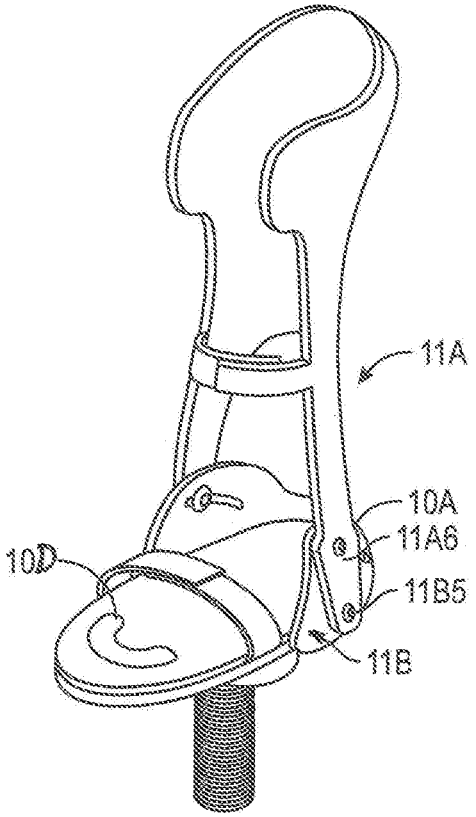
FIG. 32A depicts a frontal perspective view of a hand-glove assembly shown with its adjustable forearm bracket member set in a first angle position.
Figure 32B:
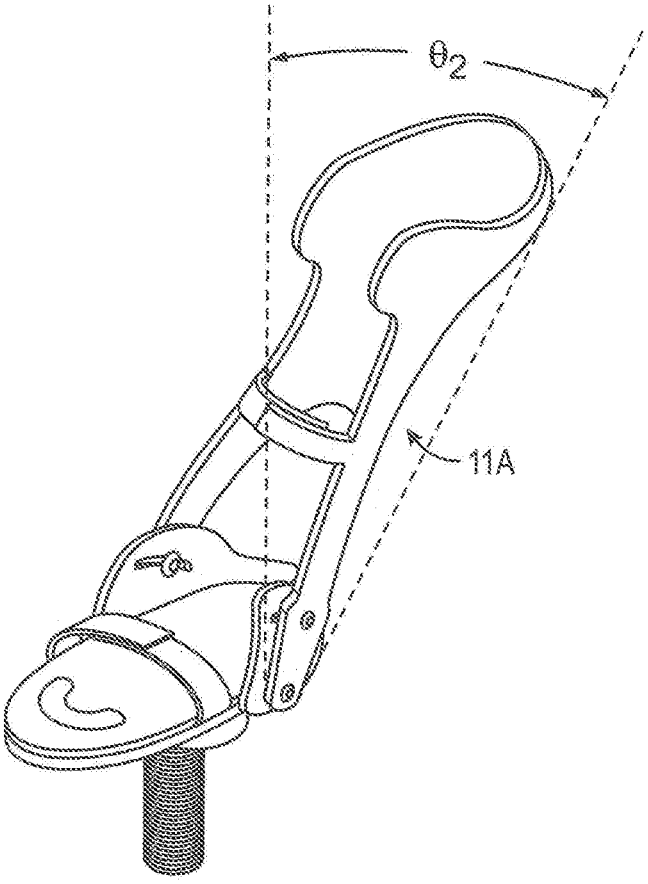
FIG. 32B depicts a frontal perspective view of the hand-glove assembly of FIG. 32A shown with the forearm bracket member adjusted to a second angle position.

FIG. 32A shows the brace 11A in a nearly upright position, while FIG. 32B illustrates the brace being pivoted backward along the slot Also referring to FIG. 19, a different internal stabilizer cylinder retainer member 30AR is also provided to permit pivoting movement of the retainer in a front-to-back direction (about angle θ), as well as some pivoting pavement of the retainer outwardly in a direction away from the opposed arm. However, to minimize wrist waggle, the internal stabilizer cylinder retainer member 30AR is designed to restrict pivoting movement inwardly (to the inside, IS, in the direction toward the opposed hand).

Specific, atypical rod of the internal stabilizer cylinder retainer 30AR will be designed according to experimental data. Instead of user's wrist function which has been limited without waggle by forearm-bracket 11A during user's crawling locomotion, the interaction of retainer rod 30AR2 and the bore hole 3D is supposed to imitate the function of a human's wrist-joint by regulating the lateral motions of the hand glove 5, 11. For example, to prevent hand glove from inward waggle (towards the inside, IS), the inward side of the atypical rod should be closer to the wall of the borehole 3D as much as possible; on the other hand, to allow hand glove with a larger backward sway, the backward side of the atypical rod should keep a larger distance from the wall of borehole 3D. Proper atypical rod provides the user with a comfortable experience on crawling locomotion. In one embodiment, the hemisphere end of the rod 30AR has a diameter the same as the bore hole 3D of the stabilizer cylinder, which allows the hand glove having lateral movements.

Different from the original designs of, e.g., FIG. 11, the upper spring retainer 30A should be a portion of the housing cylinder longer enough to hold the spring firmly.

Different from the original designs, the stabilizer cylinder 3 may have the same external diameter as the housing cylindrical member 20.

Figure 48:
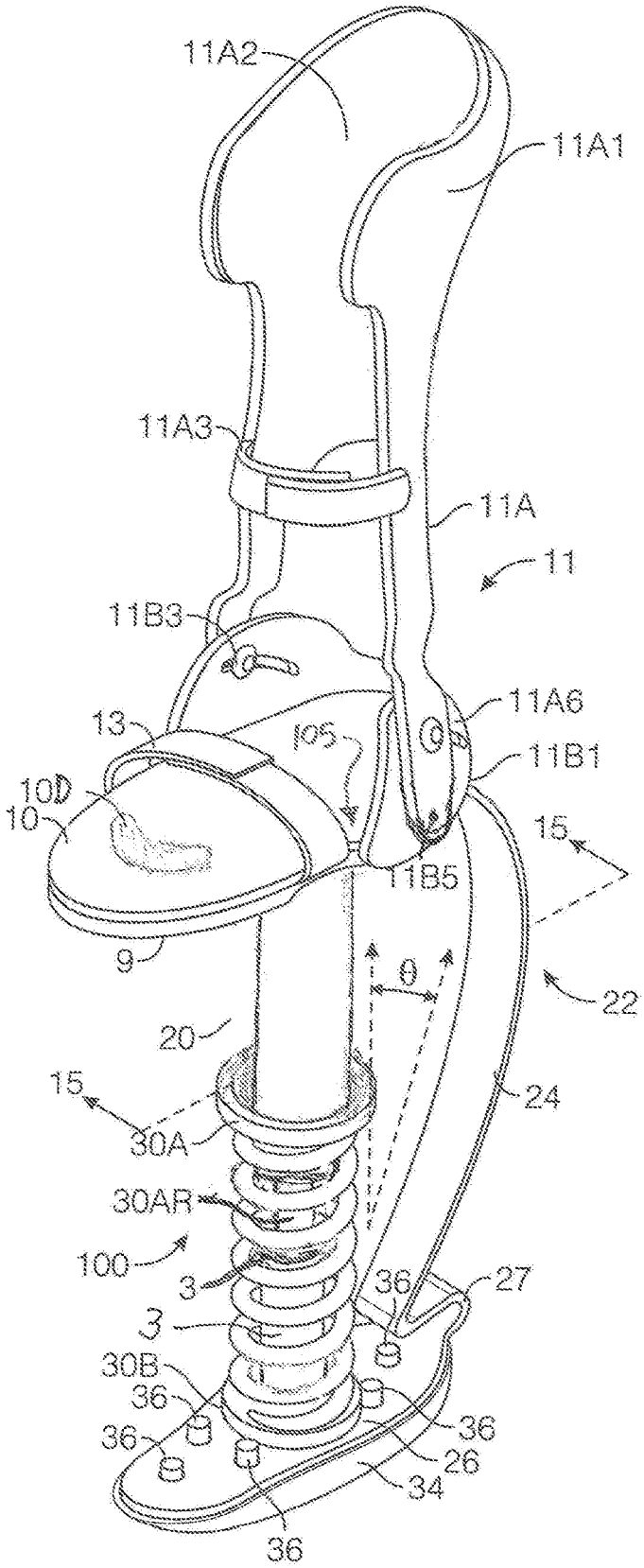
FIG. 48 depicts a frontal perspective view of another hand-crawler embodiment of the present invention similar to that depicted in FIG. 25, wherein the spring is retained along the outside of housing member via retainers such as depicted in FIGS. 46 and 47, and showing another glove apparatus embodiment providing a cut-out or indented inside to receive the user's thumb.
Figure 49:
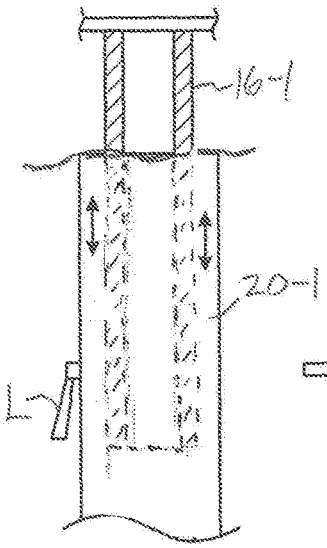
FIG. 49 generally depicts an alternative embodiment of the height adjustment feature of the hand-crawling device, generally showing height adjustment by way of a hydraulic piston mechanism, much like the hydraulic height adjustment available on office swivel desk chairs.

Different from the original designs, referring the FIG. 48, an obstruction ring 30A has been added on the lower portion of the housing cylinder 20 to create an upper spring retainer directly.

Figure 33:
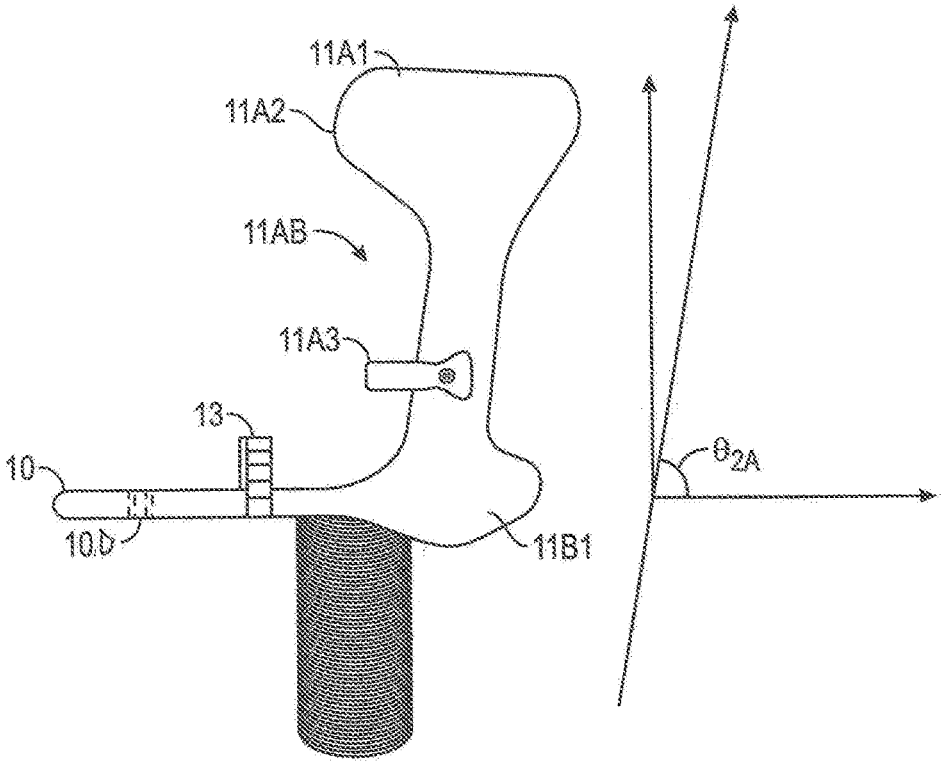
FIG. 33 depicts a side plan view of another hand-glove assembly with a fixed angle forearm-bracket member.
Figure 34:
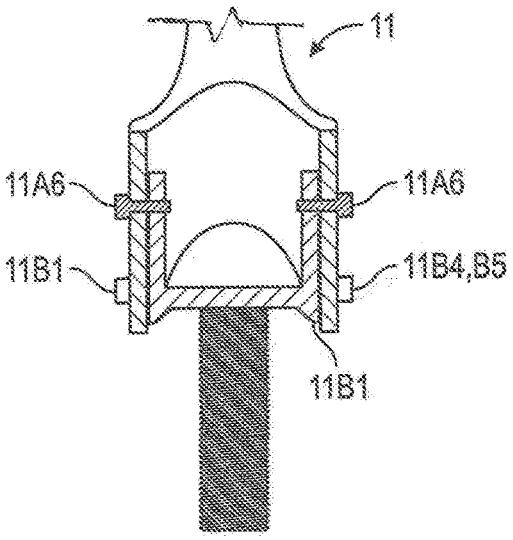
FIG. 34 depicts a portion of the hand-glove assembly shown in FIG. 27A directed to the adjustable interface between the forearm bracket member and the base member where it attaches.
Figure 35A:
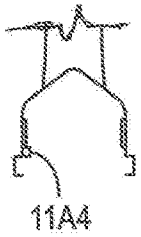
FIG. 35A schematically shows a portion of the forearm bracket member and is resistance cogging on its inner face where it interacts with the resistance cogging on the outside face of the base member where it attaches.
Figure 35B:
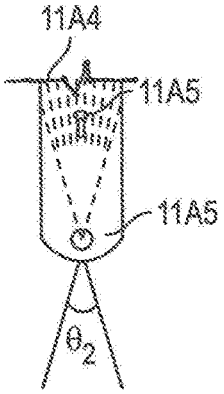
FIG. 35B schematically shows a portion of the outside of the base member and is resistance cogging on its outer face where it interacts with the resistance cogging on the inside face of the forearm bracket member where it attaches, the interplay between the opposed resistance cogs providing a mechanism for locking the angle of the forearm bracket member.
Figure 36:
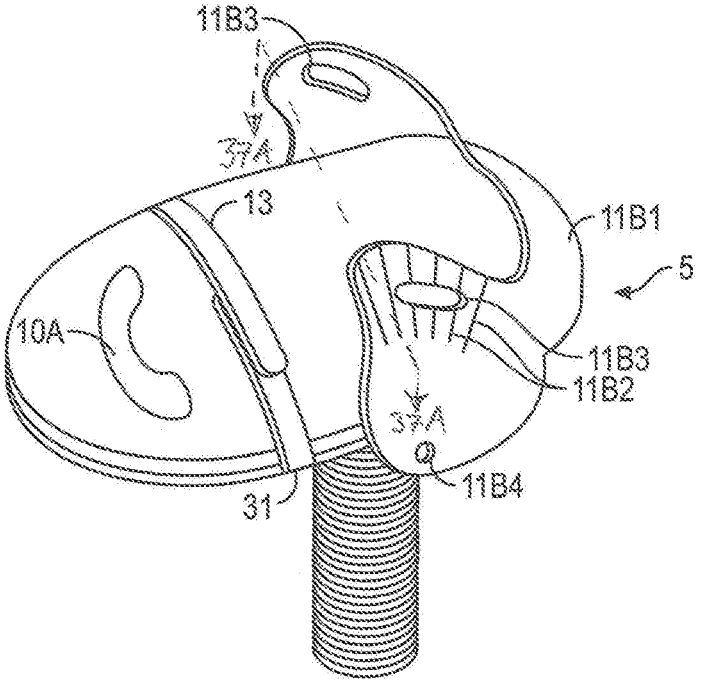
FIG. 36 depicts a perspective view of another hand-glove assembly with an adjustable angle forearm-bracket member, where the forearm-bracket has been removed to display the resistance cogging on the outer face of the base member.
Figure 37A:
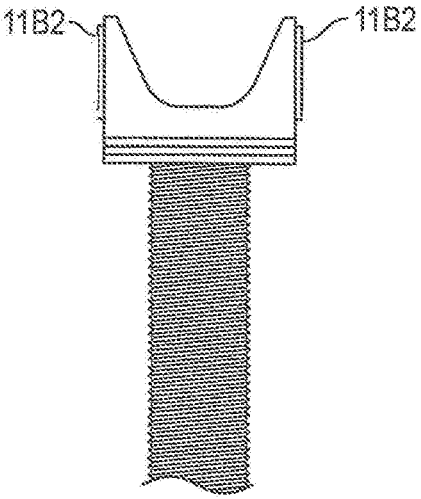
FIG. 37A depicts a portion of a cross-sectional view taken along lines 37A-37A of FIG. 36 directed to the adjustable interface between the forearm bracket member (shown removed) and the base member where it attaches.
Figure 37B:
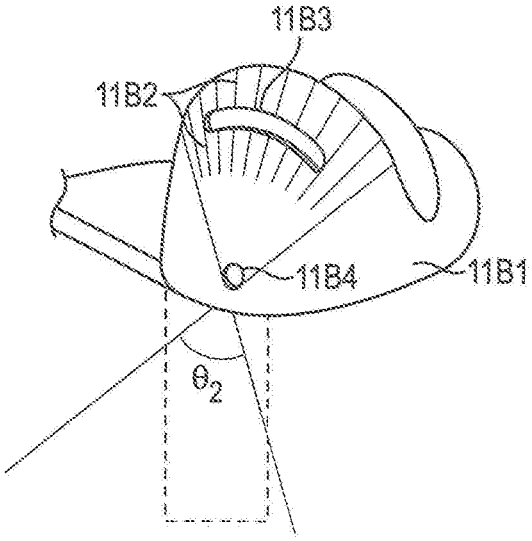
FIG. 37B depicts a portion of a rear left perspective view of the embodiment of FIG. 36 directed to the adjustable interface between the forearm bracket member (shown removed) and the base member where it attaches.
Figure 38:
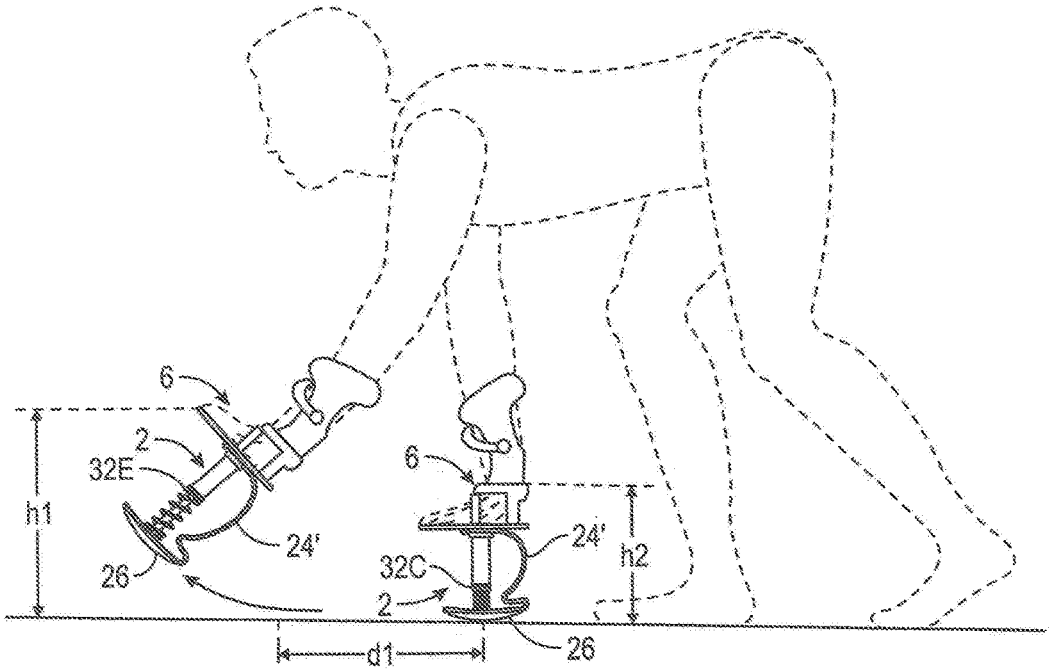
FIG. 38 depicts a simplified side perspective view of a user engaging in power-walking with the embodiment depicted in FIG. 25.
Figure 39:
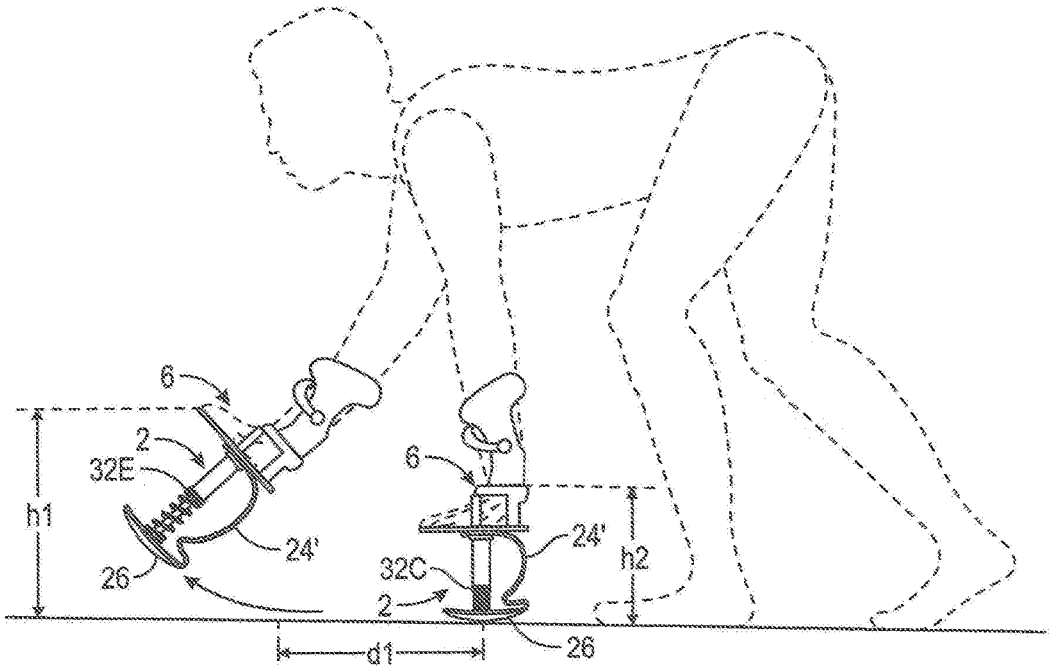
FIG. 39 depicts a simplified side perspective view of a user engaging in power-walking with the embodiment depicted in FIG. 25, in a walking position sequentially-related to the position depicted in FIG. 38.
Figure 40:
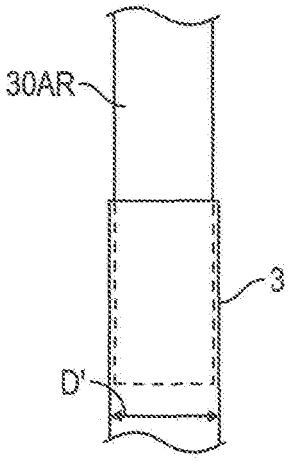
FIG. 40 shows an isolated side view of the internal stabilizer cylinder retainer inserted into the internal stabilizer cylinder member as depicted in FIG. 15.
Figure 41:
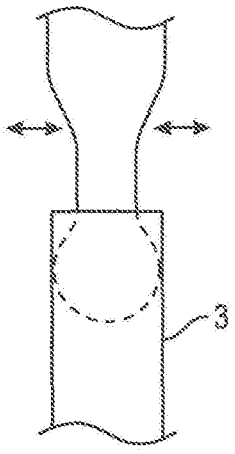
FIG. 41 shows an isolated side view of another embodiment of an internal stabilizer cylinder retainer inserted into the internal stabilizer cylinder member much like as depicted in FIGS. 25, 26 and 27A.
Figure 42:
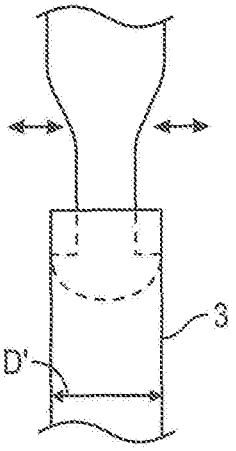
FIG. 42 shows an isolated side view of another embodiment of an internal stabilizer cylinder retainer inserted into the internal stabilizer cylinder member much like as depicted in FIGS. 25, 26 and 27A.
Figure 43:
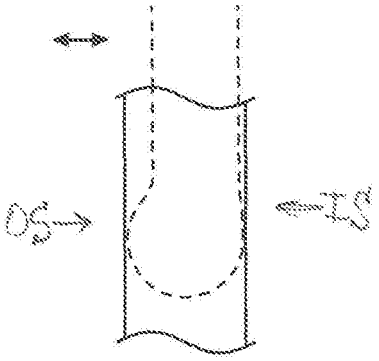
FIG. 43 generally depicts an isolated front plan view similar to that in FIG. 27B intended for use on the embodiment worn on the right hand of a user to reduce inward pivoting (toward the opposite hand) of the internal stabilizer cylinder retainer in the direction of the left hand while permitting outward pivoting, and front-to-back pivoting.
Figure 44:
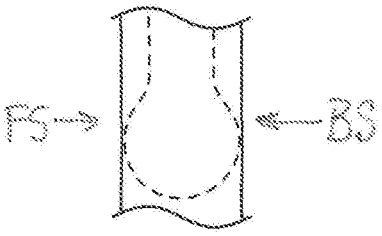
FIG. 44 generally depicts an isolated side plan view similar to that in FIG. 27D intended for use on the embodiment worn on the right hand of a user to reduce inward pivoting (toward the opposite hand) of the internal stabilizer cylinder retainer in the direction of the left hand while permitting outward pivoting, and front-to-back pivoting.
Figure 45:
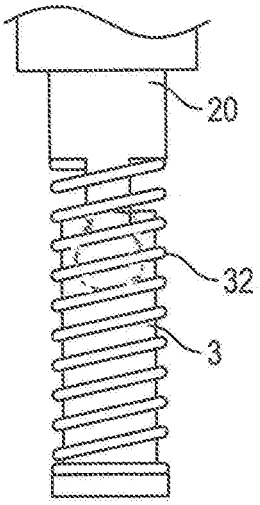
FIG. 45 generally depicts an isolated side plan view similar to that in FIG. 27D intended for use on the embodiment worn on the right hand of a user to reduce inward pivoting (toward the opposite hand) of the internal stabilizer cylinder retainer in the direction of the left hand while permitting outward pivoting, and front-to-back pivoting wherein the spring is shown engaged between the spring upper and lower retainer members where the spring upper retainer is formed from a lower inside shoulder of the housing member in the same manner as in FIGS. 11, 12 and 13A.
Figure 46:
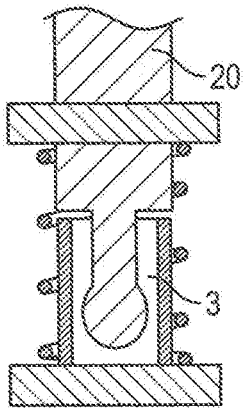
FIG. 46 generally depicts an isolated side plan view similar to that in FIG. 27D intended for use on the embodiment worn on the right hand of a user to reduce inward pivoting (toward the opposite hand) of the internal stabilizer cylinder retainer in the direction of the left hand while permitting outward pivoting, and front-to-back pivoting wherein the spring is shown engaged between the spring upper and lower retainer members where the spring upper retainer is formed on the outside of the housing member in the same manner as depicted in FIGS. 25, 26 and 27A.
Figure 47:
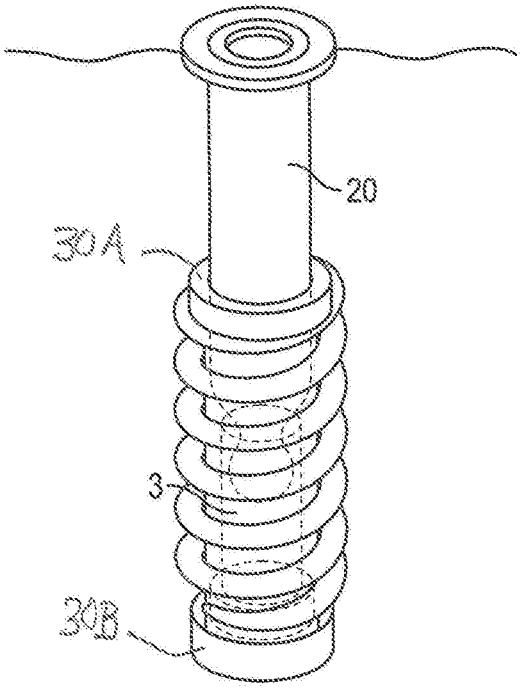
FIG. 47 is an isolated perspective view of FIG. 47.

Referring now to FIG. 33, there is depicted a forearm bracket member 11AB that has a fixed or stationary (non adjustable) angle $\theta_{2A}$. This stationary angle has a backward-tilting angle of angle $\theta_{2A}$ no less than 60°; e.g., 60° to 85°).

Figure 50:
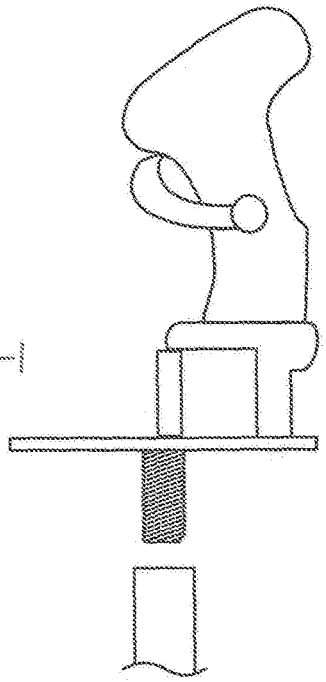
FIG. 50 generally depicts an side view of the hand-glove device capable of height adjustment via a threaded connection as in, e.g., FIG. 26.
Figure 51A:
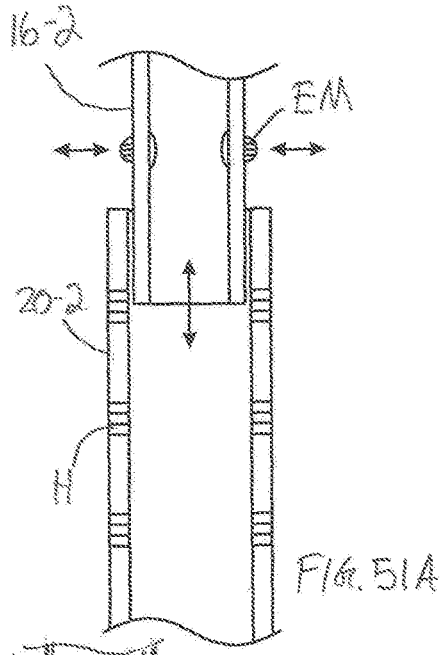
FIG. 51A generally depicts a cross-sectional view of an alternative embodiment of height adjustment wherein the height adjustment is accomplished via spring-loaded pins or engagement members that can engage in a desired spaced-apart height adjustment hole when the inner tubular member is inserted within the outer tubular member.
Figure 51B:
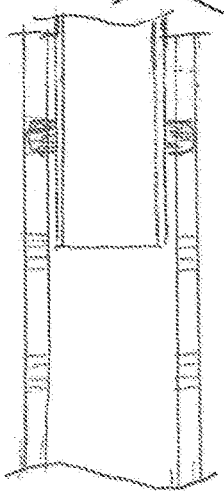
FIG. 51B shows the embodiment of FIG. 51A wherein the spring-loaded pins are engaged with the outer tubular member.
Figure 52:
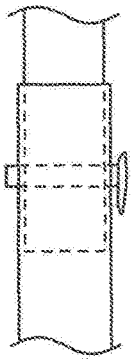
FIG. 52 generally depicts a cross-sectional view of an alternative embodiment of height adjustment wherein the height adjustment is accomplished via a series of aligned, spaced apart height adjustment holes in the inner and outer tubular members and a spring-loaded pin that can engage therethrough to maintain the position of the inner tubular member to the outer tubular member.
Figure 54:
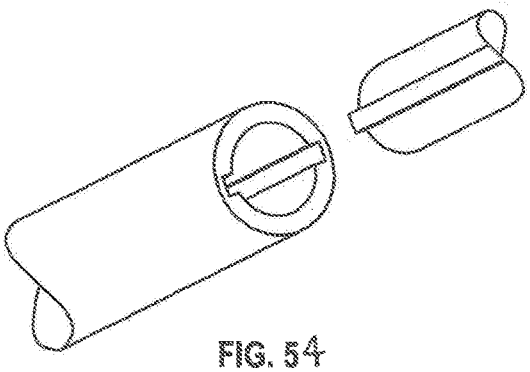
FIG. 54 generally depicts an anti-rotational channel lock that may be employed on the height adjustment embodiments depicted in FIGS. 49, 51A, 51B, 52 and 53 to prevent rotation of the inner tubular member relative to the outer tubular member.
Figure 53:
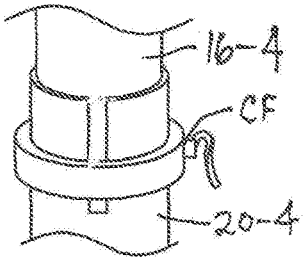
FIG. 53 generally depicts a cross-sectional view of an alternative embodiment of height adjustment wherein the height adjustment is accomplished via a compression fitting that can be tightened to restrict further movement of the inner tubular member relative to the outer tubular member.

FIGS. 49, 51A, 51B, 52 and 53 provide alternative mechanisms (other than the threaded height adjustment shown in FIG. 50) for providing height adjustment of the hand-crawling device. For example, FIG. 49 generally shows height adjustment by way of an axially oriented hydraulic piston mechanism where post member 16-1 and housing member 20-1 interact hydraulically, much like the hydraulic height adjustment available on office swivel desk chairs. In this embodiment, a locking latch L can serve to release the pressure to permit height adjustment, and to then lock such adjusted height into place. FIGS. 51A and 51B generally depict cross-sectional views of an alternative embodiment of height adjustment wherein the height adjustment is accomplished via spring-loaded pins or engagement members EM that can engage in a desired spaced-apart height adjustment hole(s) H located in housing 20-2 when the inner tubular member or post member 16-2 is inserted within the outer tubular member housing member 20-2. FIG. 52 generally depicts a cross-sectional view of an alternative embodiment of height adjustment wherein the height adjustment is accomplished via a series of aligned, spaced apart height adjustment holes in the inner and outer tubular members and a spring-loaded pin that can engage therethrough to maintain the position of the inner tubular member to the outer tubular member. FIG. 53 generally depicts a cross-sectional view of an alternative embodiment of height adjustment wherein the height adjustment is accomplished via a compression fitting CF that can be tightened to restrict further movement of the inner tubular member 16-4 relative to the outer tubular member 20-4. FIG. 54 generally depicts an anti-rotational channel lock that may be employed on the height adjustment embodiments depicted in FIGS. 49, 51A, 51B, 52 and 53 to prevent rotation of the inner tubular member relative to the outer tubular member.

Thus, it will be appreciated by those skilled in the art, that embodiments of the present invention, when invoked by users manifesting sufficient physical skill and exemplary fitness, may achieve astonishing levels of whippy locomotion heretofore thought impossible and, indeed, heretofore not even contemplated.

Accordingly, it should be clearly understood that the present invention is not intended to be limited by the particular features and structures hereinbefore described and depicted in the accompanying drawings, but that the present invention is to be measured by the scope of the appended claims.

The following is a tabulation of the components depicted in the drawings in which instances of primes or multiples thereof are representative of the same component, but incorporated into different embodiments of the present invention, e.g., 5 or 5', 6 or 6', 100 or 100' or 100" or 100'", etc.:

Component Listing

| Numeral | Component | Explanation |
|---|---|---|
| 2 | Hand-crawler glove apparatus, with either a single flat zonal arcuate brace member or a double rod arcuate brace member | Cylindrical cross-section |
| 3 | Internal stabilizer cylinder member, spring retainer lower member | Support; removable |
| 3A | Slit | Accommodates adjustments by screw driver |
| 3B | Whorl | |
| 3C | Bottom portion | |
| 3D | Bore Hole | |
| 5 or 5' | Hand Glove assembly | for different embodiments |
| 6 or 6' | Hand-in-glove | User's hand secured within glove apparatus; For different embodiments |
| 7 | Hand-crawler glove apparatus, with either a single flat zonal arcuate brace member or a double rod arcuate brace member, and also including removable stabilizer cylinder | Same cylindrical structure as in numeral 2, but reinforced with optional stabilizer cylinder |
| 107, 107a | Hand-crawler glove apparatus, with either a single flat zonal arcuate brace member or a double rod arcuate brace member, and also including removable stabilizer cylinder | |
| 8 | Top layer of Hand Platform | |
| 9 | Bottom layer of Hand Platform | |
| 10 | Hand Platform | Top surface, for receiving a hand |
| 10A | Front portion | Enclosing fingers of a hand |
| 10B | Rear portion | Enclosing heel of a hand |
| 10C | Sole portion, layered | 2 layers (8 & 9) |
| 10D | Finger slot | For receiving curved fingers rather than laying flat |
| 10E | Thumb contour | For receiving thumb rather than laying flat |
| 11 | Hand Glove assemblies | |
| 11A | Forearm-Bracket Member, Wrist fixer, real, leg members | Angle Adjustable |
| 11AB | Angle stationary forearm-bracket | With a backward-tilting Angle |
| 11A1 | Curving Brace, upside of forearm bracket | |
| 11A2 | Top layer of Forearm-Bracket | Soft material |
| 11A3 | Strap | 1 or 2 straps of any variety |
| 11A4 | Radial cogging member | On both left and right sides of low portion of wrist fixer member legs |
| 11A6 | Tighteners, Bolts and Hand Nuts | |
| 11B | Thick Parapet, Substrate Assembly | |
| 11B1 | Thick Parapet member, Thick Substrate | Accommodating forearm-bracket member |
| 11B2 | Raised Radial cogging member | On both left and right sides of thick parapet |
| 11B3 | Slot member | Tracks for movement of wrist fixer member |
| 11B4 | Apertures on low potion of Substrate | Receiving axis |
| 11B5 | Axis, Joint of wrist fixer member | Bolts, nuts |
| 111 | Hand-crawler glove apparatus, devoid of arcuate brace member, and also including optional stabilizer cylinder | Piston-like operation |
| 12 | Hand-embracing member, front: fingers | Strap |
| 13 | Hand-embracing member, front: fingers | Strap |
| 14 | Hand-embracing member, rear: heel & wrist | dorsal Strap |
| 15 | Post Assembly | |
| 16 | Post member | Threaded |
| 16-1 | Hydraulically moveable post member | Hydraulically adjustable within housing member 20-1 |
| 16-2 | Moveable post member with spring loaded engagement members EM | Permits height adjustment between post member 16-2 and housing member 20-2 |
| 16-3 | Moveable post member with height adjustment holes for receiving height adjustment pin P | Permits height adjustment between post member 16-3 and housing member 20-3 |

-continued

| Component Listing | | |
|---|---|---|
| Numeral | Component | Explanation |
| 16-4 | Coaxial height adjustment secured by compression fitting CF | Permits height adjustment between post member 16-4 and housing member 20-4 |
| 17 | Top portion | |
| 18 | Thread members | |
| 19 | Groove pairs | Symmetrically disposed relative to post |
| 20 | Housing Member | Cylindrical; enclosing Post member 16 |
| 20-1 | Hydraulic housing Member | Interacts hydraulically with post member 16-1 |
| 20-2 | outer tubular housing member | With height adjustment holes for receiving engagement member EM |
| 20-3 | outer tubular housing member | With height adjustment holes for receiving a locking pin P |
| 20-4 | Outer tubular housing member for securing height adjustment with compression fitting CF | Interacts axially with inner tubular post member 16-4 |
| 20A | Ring member | Preferably contiguous with top of housing |
| 20B | Lower Ring Member | To create a spring retainer |
| 22 | Brace Assembly | angle θ |
| 24 | Brace Support Member: Zonal, Flat | Arcuate Shoulder Configuration |
| 25 | Brace Support Member, Double | Arcuate Shoulder Configuration |
| 25A, B | Dual Parallel Brace Pair | Alternative configuration, angle θ |
| 26 | Base Member | Bottom Support |
| 26A | Gap member | Accommodates elastic distortion |
| 28 | Apertures for receiving Studs 36 | |
| 27 | Elastomeric bends, To-and-fro Bends, Reciprocating Bends | Lower Position |
| 28A | Aperture in base member 26 | Through which stabilizer cylinder 3 inserted |
| 29 | Brace Support Member, Single | Arcuate Shoulder Configuration |
| 30A | Spring Retainer, Upper Member; obstruction ring lower portion of the housing cylindrical member | Holding spring within Bracket Assembly, from above with enough length to prevent spring 32 dop |
| 30AR | Internal Stabilizer Cylinder Retainer | |
| 30AR1 | Hemisphere end of 30AR | the same diameter as 3D (Bore Hole) |
| 30AR2 | Atypical Rod of 30AR | |
| 30B | Spring Retainer, Lower Member, or internal stabilizer cylinder retainer | Holding spring or stabilizer cylinder within Bracket Assembly, from below |
| 30BS | Internal Stabilizer Cylinder whorl | |
| 30C | Single spring retainer member | |
| 30D | Top portion, disposed within housing member 20 | |
| 30E | Recess pair | For tightly retaining screw member 39 against post member 16 |
| 31 | Void within housing 20, below upper threaded portion | |
| 31B | Shoulder members disposed at bottom of void 31, holding top portion 30D of spring retainer 30C | |
| 32 | Compression Spring Member | |
| 34 | Sole Member | Rubberized; Skid Resistant |
| 36 | Stud Member | Insert into corresponding Stud Apertures 28 |
| 38 | Whorl Hole | Centrally & axially disposed within the cylindrical housing & having internal threads mated with post threaded members |
| 39 | Fastener member, connecting lower portion of spring retainer member 30C | Bolt |
| 40 | Set of Securing Fasteners | Bolts or wing-nuts, to adjust height of column |
| 42 | Crutch embodiment | |
| 45 | Crutch | Screwable trunk bottom rather than rubber tip |
| 46 | Pad | Arm pit |
| 47 | Hand-grip | Adjustable height (not shown) |
| 48 | Frame | Holes for adjusting height of hand-grip |
| 48A | Left-side Portion | |
| 48B | Right-side Portion | |
| 49 | Holes to adjust hand-grip height | |
| 50 | Post Support, adjustable | Threaded |
| 52 | Post, threaded | |
| 55 | Threads | |

-continued

| Component Listing | | |
|---|---|---|
| Numeral | Component | Explanation |
| 100 or 100' or 100" or 100"' | Base assembly for different embodiments | Lower portion of embodiments, encompassing post assembly (15); housing member (20); spring member (32) & its associated components; base member (26) and its associated components; optionally brace assembly (22) |
| $\theta$ | Angle of support relative to vertical | Varies from about 95° to 135° |
| $\theta_2$ | Angle of wrist-fixer relative to vertical | Angle optional from 55° to 90° (90° to 125°) |
| $\theta_{2A}$ | Angle of stationary forearm-bracket | Angle no less than 60°; (60° to 85°) |
| d1, d2 | Horizontal distance traversed by user during first & second cycle | |
| CF | Compression fitting | |
| EM | Engagement member | Spring-loaded to lock into height adjustment hole H |
| L | Locking latch | Release and lock hydraulically actuatable height adjustment between post member and housing memnber |
| H | spaced-apart height adjustment holes | |
| P | Pin for securing height position | |
| h1, h2 | Elevated height of user's hand after hand-jump | driven by decompressed or expanded spring; about ¼ to ½ inch |
| IS | Inside or inner side | The side of the device facing towards the opposite hand; the thumb side of the device when worn by user |
| OS | Outside or outer side | The side of the device facing away from the opposite hand when worn by user |
| FS | Front side or front end | The front side or front end of the device; the finger end of the device |
| BS | Back side or rear end | The back side or rear end of the device; the hand/wrist end of the device |
| s1 | Gap between stabilizer cylinder retainer 39AR and bore hole 3D | Accommodates horizontal deflection occurring during whippy motion |

While the invention has been described in terms of preferred embodiments, it will be apparent to those of skill in the art that variations may be applied to the process and system described herein without departing from the concept and scope of the invention. All such similar substitutes and modifications apparent to those skilled in the art are deemed to be within the scope and concept of the invention. Those skilled in the art will recognize that the method and apparatus of the present invention has many applications, and that the present invention is not limited to the representative examples disclosed herein. Moreover, the scope of the present invention covers conventionally known variations and modifications to the system components described herein, as would be known by those skilled in the art. While the apparatus and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

I claim:

1. A hand-crawling apparatus having a pair of hand-crawling members for enabling a user having particular weight and height attributes to engage in whippy locomotion, with each of the pair of hand-crawling members thereof comprising:

a hand-glove assembly having a planar hand-platform member with a top surface and a bottom surface;

a hand-embracing forearm support bracket member affixed to the top surface of the planar hand-platform member;

a cylindrical post member affixed at one end thereof to the bottom surface of the planar hand-platform member, the cylindrical post member projecting perpendicularly therefrom and downwardly thereof, the cylindrical post member having a cylindrical post member outer surface;

a base assembly comprising a cylindrical housing member having an upper end and a lower end, the cylindrical housing member upper end having an axially disposed central bore sized to receive and mate with the cylindrical post member outer surface, the cylindrical housing member being attached to the cylindrical post member; and the base assembly having a replaceable spring member disposed immediately below the cylindrical housing member and secured in a vertical position between a first retainer member affixed thereto at one end of the replaceable spring member and a second retainer member therebelow affixed to a planar base plate member at the other opposite end of the replaceable spring member, each of the pair of hand-crawling members further comprising a front end, a rear end opposite thereto, an outer side and an inner side, and wherein, when the user is using each of the pair of hand-crawling members to engage in whippy locomotion, the inner side of one of the pair of hand-crawling members faces the inner side of the other one of the pair of hand-crawling members.

2. The hand-crawling apparatus recited in claim 1, wherein the hand-glove assembly further comprises a front hand-embracing member disposed at a first end of the planar hand-platform member proximate the front end of each of the pair of hand-crawling members and affixed thereto, for embracing fingers of a hand of the user and having a hand-glove assembly strap member for securing the fingers thereto.

3. The hand-crawling apparatus recited in claim 2, wherein the hand-glove assembly further comprises a rear hand-embracing upwardly extending parapet substrate member disposed at a second end of the planar hand-platform member, oppositely of the first end thereof, proximate to the rear end and attached to the hand-platform member of each of the pair of hand-crawling members, for embracing a heel and wrist of the hand of the user and for attaching the hand-embracing forearm support bracket, the parapet substrate member upwardly extending from an inside and an outside edge of the planar hand-platform member proximate the respective inner side and outer side of each of the pair of hand-crawling members, the hand-embracing forearm support bracket further comprising an upwardly extending member attached at a first end to the parapet substrate member for receiving a forearm of the user, and one or more parapet substrate member strap members for securing the hand-embracing forearm support bracket to the user's forearm, the hand-embracing forearm support bracket extending upwardly at a desired wrist orientation angle relative to the planar hand-platform member.

4. The hand-crawling apparatus recited in claim 3 wherein the hand-embracing forearm support bracket is pivotably attached to the parapet substrate member about a parapet pivot axis to provide adjustability to the wrist orientation angle by permitting pivoting of the hand-embracing forearm support bracket in a first direction toward the front end of the hand-crawling apparatus or in a second, opposite direction toward the rear end of the hand-crawling apparatus, and permitting locking the hand-embracing forearm support bracket into place prior to use by the user.

5. The hand-crawling apparatus recited in claim 4 wherein the first end of the hand-embracing forearm support bracket comprises opposed leg members capable of being pivotally attached at the hand-embracing forearm support bracket first end to the parapet pivot axis on the respective inside and outside of the parapet substrate member and secured in the desired wrist orientation angle.

6. The hand-crawling apparatus recited in claim 5 wherein the inside and outside of the parapet substrate member further each comprise an arcuate guide slot oriented in a front to back orientation, the opposed leg members of the hand-embracing forearm support bracket further comprise guide pins secured thereto capable of travelling within the arcuate guide slot when the hand-embracing forearm support bracket is pivoted front to back, and further capable of securing the hand-embracing forearm support bracket to the parapet substrate in the desired wrist orientation angle.

7. The hand-crawling apparatus recited in claim 5 wherein a plurality of raised cogging members are oriented on a face of the parapet substrate member between the arcuate guide slot and the parapet pivot axis, and wherein the plurality of raised cogging members are oriented on an inner face of each of the opposed members between the guide pins and the parapet pivot axis for frictionally engaging with one or more of the plurality of raised cogging members on the outer face of the parapet substrate member to assist in maintaining the hand-embracing forearm support bracket in the desired wrist orientation angle.

8. The hand-crawling apparatus recited in claim 3 wherein the hand-embracing forearm support bracket is fixably attached to the parapet substrate member at the desired wrist orientation angle.

9. The hand-crawling apparatus recited in claim 2 further comprising a finger slot in the front hand-embracing member for receiving the fingers of the user.

10. The hand-crawling apparatus recited in claim 1, wherein the base assembly has a brace assembly affixed to a top surface of the planar base plate member at one end thereof spaced apart from the cylindrical post assembly and with an arcuate flexible brace support member adjoined with the cylindrical housing member at a top portion thereof.

11. The hand-crawling apparatus recited in claim 10, wherein the arcuate flexible brace support member is configured with an arc preferably having an angle from 95° to 135° to augment support of the planar hand-platform member and to simultaneously provide sufficient flexion.

12. The hand-crawling apparatus recited in claim 11, wherein the base assembly further comprises a removable stabilizer cylinder member having an internal bore hole of a first diameter, the removable stabilizer cylinder member being screwably inserted thereinto through a whorl hole centrally disposed on the bottom of the planar base plate member and threadedly mated therewith and secured therein with an internal stabilizer retainer member, thereby preventing undue lateral movement of the planar hand-platform member.

13. The hand-crawling apparatus recited in claim 12, wherein the internal stabilizer retainer member is a cylindrical structure extending axially from the lower end of the cylindrical housing member and comprises an outer diameter capable of being inserted into the internal bore hole of the removable stabilizer cylinder member.

14. The hand-crawling apparatus recited in claim 12, wherein the internal stabilizer retainer member extends downwardly from the lower end of the cylindrical housing member and comprises a first axially offset section oriented facing the inner side of the hand-crawling apparatus which, a second section opposite the first section oriented facing the outer side of the hand-crawling apparatus, a third section oriented facing the front end of the hand-crawling apparatus and a fourth section oriented facing the rear end of the hand-crawling apparatus such that when the internal stabilizer retainer member is inserted into the internal bore hole of the removable stabilizer cylinder member, it is configured to nest up against an internal side wall of the internal bore hole facing the inner side of the hand-crawling apparatus to reduce lateral movement of the planar hand-platform member in a direction toward the inner side of the hand-crawling apparatus, while permitting lateral movements in directions of the outer side, the front end and the rear end of the hand-crawling apparatus.

15. The hand-crawling apparatus recited in claim 12, wherein the internal stabilizer retainer member further comprises a hemispherical end having an outer diameter sized to permit entry into the internal bore hole.

16. The hand-crawling apparatus recited in claim 11, wherein the arcuate flexible brace support member comprises a zonal flat configuration.

17. The hand-crawling apparatus recited in claim 11, wherein the arcuate flexible brace support member comprises a double cylindrical parallel configuration.

18. The hand-crawling apparatus recited in claim 1, wherein the base assembly has a plurality of gap members disposed upon the planar base plate member and circumferentially of the cylindrical post member for accommodating elastic distortion of the planar base plate member during the whippy locomotion.

19. The hand-crawling apparatus recited in claim 18, wherein each gap member of the plurality of gap members is configured as a wedge shaped void cut out from the planar base plate member.

20. The hand-crawling apparatus recited in claim 18, wherein a pair of flat recess members are disposed upon opposing sides of the cylindrical post member to enable the first spring retainer member to securely retain the replaceable spring member within the cylindrical housing member.

21. The hand-crawling apparatus recited in claim 1, wherein the cylindrical post member further comprises external threads circumferentially disposed upon the cylindrical post member outer surface, and wherein the cylindrical housing member axially disposed central bore comprises a whorl hole with internal threads sized to receive and mate with the external threads of the cylindrical post member.

22. The hand-crawling apparatus recited in claim 21, wherein the external threads of the cylindrical post member has a pair of groove members laterally and symmetrically disposed thereupon, and wherein the planar hand-platform member is rotated about the cylindrical post member to adjust a height thereof above the base assembly to be commensurate with the user's height attribute and then is securely engaged with one of the pair of groove members at an adjusted height with a wing nut disposed upon a ring member contiguous with and affixed to the cylindrical housing member.

23. The hand-crawling apparatus recited in claim 1, wherein the planar base plate member is attached in its entirety therebeneath to a skid-resistant elastomeric sole member by a plurality of stud members affixed to an upper surface of the skid-resistant elastomeric sole member projecting vertically therefrom which are received in a plurality of stud member holes contained on the planar base plate member and being secured thereof by a plurality of nut members.

24. A method of exercising using the hand-crawling apparatus of claim 23, where the user commences undulating alternating upward and downward whippy locomotion therewith, comprising the steps of:

receiving one of the user's hands into the hand-embracing forearm support member of one of the pair of hand-crawling members, the one of the user's hands being releasably secured thereto and receiving an other one of the user's hands into the hand-embracing forearm support member of an other of the pair of hand-crawling members, the other one of the user's hands being releasably secured thereto;

positioning a body of the user into a crawling posture with each of the pair of hand-crawling members and feet of the user being placed upon the ground;

initiating leading forward locomotion with the one of the pair of hand-crawling members being propelled upwardly by expansion of the replaceable spring member of the one of the pair of hand-crawling members, while simultaneously a weight of the user self-generates force downwardly thereby urging trailing forward locomotion with the other of the pair of hand-crawling members imparting pressure thereupon thereby causing the replaceable spring member of the other of the pair of hand-crawling members to transition from being uncompressed to being compressed;

continuing forward locomotion by disposing the one of the pair of hand-crawling members and the other of the pair of hand-crawling members in a diametrically opposite arrangement with the other of the pair of hand-crawling members being propelled upwardly by expansion of the replaceable spring member of the other of the pair of hand-crawling members, while simultaneously the user's weight self-generates force downwardly thereby urging trailing forward locomotion with the one of the pair of hand-crawling members imparting pressure on the replaceable spring member of the one of the pair of hand-crawling members thereby causing the replaceable spring member of the one of the pair of hand-crawling members to transition from being uncompressed to being compressed; and intermittently effectuating successive compression and decompression of the replaceable spring member of the one of the pair of hand-crawling members and the replaceable spring member of the other of the pair of hand-crawling members thereby enabling the whippy locomotion to be continued so long as the user engages each of the pair of hand-crawling members.

25. The hand-crawling apparatus recited in claim 1, wherein the planar hand-platform member comprises a shock-absorption material selected from cork or gel to promote comfort and to avoid injury to a plethora of bones and concomitant ligaments and muscles constituting and proximal to hands of the user and similarly, to a back of the user.

26. The hand-crawling apparatus recited in claim 1 wherein the cylindrical post member is received into the base member axially disposed central bore in a hydraulically adjustable fashion to permit adjustment of a height thereof above the base assembly to be commensurate with the user's height attribute, the cylindrical post member capable of being securely engaged within the base member axially disposed central bore at the desired height and to be secured in place with a hydraulic locking mechanism.

27. The hand-crawling member recited in claim 1, wherein the replaceable spring member is inserted between the first retainer member and the second retainer member, and secured therebetween.

28. The hand-crawling apparatus recited in claim 1 further comprising a contoured indentation along the inner side of each of the of hand-crawling members to accommodate a thumb of the user.

29. The hand-crawling apparatus recited in claim 1 wherein the replaceable spring member has an inner diameter slightly greater than an outer diameter of the cylindrical housing member, and wherein the first retainer member is affixed to the outer diameter of the cylindrical housing member.

* * * * *